US011535030B2

(12) United States Patent
Sato et al.

(10) Patent No.: US 11,535,030 B2
(45) Date of Patent: Dec. 27, 2022

(54) LIQUID DISCHARGE APPARATUS

(71) Applicant: Brother Kogyo Kabushiki Kaisha, Nagoya (JP)

(72) Inventors: Shoji Sato, Okazaki (JP); Satoru Arakane, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/887,735

(22) Filed: May 29, 2020

(65) Prior Publication Data

US 2020/0376833 A1 Dec. 3, 2020

(30) Foreign Application Priority Data

May 31, 2019 (JP) ..... JP2019-102047

(51) Int. Cl.
*B41J 2/045* (2006.01)
*B41J 2/14* (2006.01)

(52) U.S. Cl.
CPC ..... *B41J 2/04561* (2013.01); *B41J 2/04503* (2013.01); *B41J 2/04526* (2013.01); *B41J 2/04573* (2013.01)

(58) Field of Classification Search
CPC ..... B41J 2/04503
See application file for complete search history.

(56) References Cited

U.S. PATENT DOCUMENTS 8,974,031 B2 3/2015 Numata
9,044,938 B2 6/2015 Morita et al.
9,315,032 B2 4/2016 Pujiatno et al.
2002/0158935 A1* 10/2002 Tatsumi ..... B41J 29/393 347/19
2005/0078134 A1* 4/2005 Igarashi ..... B41J 2/04573 347/14
2007/0103496 A1* 5/2007 Otani ..... B41J 2/04581 347/11
2010/0220134 A1* 9/2010 Matsushita ..... B41J 2/04581 347/10

(Continued)

FOREIGN PATENT DOCUMENTS

JP 2007-118425 A 5/2007
JP 2012-218360 A 11/2012

(Continued)

*Primary Examiner* — Shelby L Fidler
(74) *Attorney, Agent, or Firm* — Banner & Witcoff, Ltd.

(57) ABSTRACT

There is provided a liquid discharge apparatus including: a liquid discharge head; a relative movement mechanism performing relative movement between the liquid discharge head and a medium; a velocity signal output circuit; and a controller performing a constant velocity discharge operation and an acceleration/deceleration discharge operation. In the constant velocity discharge operation, the controller determines a discharge timing based on information about a representative value of relative velocity obtained based on a plurality of pieces of preceding velocity information. Further, in the acceleration/deceleration discharge operation, the controller obtains approximate information in which a change in the relative velocity is approximated based on distribution of the relative velocity, and the controller determines a discharge timing based on the approximate information.

12 Claims, 16 Drawing Sheets

(56) References Cited

U.S. PATENT DOCUMENTS

| | | | |
|---|---|---|---|
| 2013/0271518 | A1 | 10/2013 | Morita et al. |
| 2014/0292872 | A1 | 10/2014 | Numata |
| 2015/0158305 | A1 | 6/2015 | Pujiatno et al. |

FOREIGN PATENT DOCUMENTS

| | | | |
|---|---|---|---|
| JP | 2013-220584 | A | 10/2013 |
| JP | 2014-188875 | A | 10/2014 |
| JP | 2015-112737 | A | 6/2015 |

* cited by examiner

LIQUID DISCHARGE APPARATUS

CROSS REFERENCE TO RELATED APPLICATION

The present application claims priority from Japanese Patent Application No. 2019-102047 filed on May 31, 2019, the disclosure of which is incorporated herein by reference in its entirety.

BACKGROUND

Field of the Invention

The present disclosure relates to a liquid discharge apparatus configured to discharge a liquid from nozzles.

Description of the Related Art

As an exemplary liquid discharge apparatus configured to discharge a liquid from nozzles, there is publicly known a printer that performs printing on a recording sheet by discharging ink from the nozzles. In the publicly known printer, ink is discharged from the ink-jet head, which reciprocates in a scanning direction together with a carriage, at the time of performing printing on the recording sheet. In this situation, the ink-jet head that reciprocates in the scanning direction repeats the following: accelerating to a predefined velocity within an acceleration range, running at the predefined velocity in a constant velocity range, and decelerating in a deceleration range. The publicly known printer performs printing for all the areas facing the acceleration range, the constant velocity range, and the deceleration range of the recording sheet. Namely, ink is discharged from the nozzles in all of the case where the ink-jet head runs at the predefined velocity, the case where the ink-jet head accelerates, and the case where the ink-jet head decelerates.

SUMMARY

The publicly known printer, for example, infers a moving velocity of the ink-jet head so that ink lands on an appropriate position in the scanning direction of the recording sheet, and determines a discharge timing depending on the inferred moving velocity. When the ink-jet head is positioned in the constant velocity range, the moving velocity hardly changes. On the other hand, when the ink-jet head is positioned in the acceleration range or the deceleration range, the moving velocity changes. Thus, when the discharge timing is determined by inferring the moving velocity in the next moment of the ink-jet head through a uniform method irrespectively of the position in the scanning direction of the ink-jet head, the moving velocity of the ink-jet head can not be inferred accurately when the ink-jet head is positioned in any of the positions in the scanning direction. This may cause the discharge timing to deviate from an appropriate discharge timing.

An object of the present disclosure is to provide a liquid discharge apparatus that is capable of discharging a liquid at an appropriate discharge timing both when a relative velocity between a liquid discharge head and a medium is a constant relative velocity and when the relative velocity between the liquid discharge head and the medium increases or decreases.

According to an aspect of the present disclosure, there is provided a liquid discharge apparatus configured to discharge a liquid on a medium, including: a liquid discharge head including a nozzle and a nozzle surface in which the nozzle is opened; a relative movement mechanism configured to perform relative movement between the liquid discharge head and the medium in a direction parallel to the nozzle surface; a velocity signal output circuit configured to output a velocity signal related to a relative velocity between the liquid discharge head and the medium; and a controller. In a case that the liquid is discharged from the nozzle toward the medium, the controller is configured to: obtain velocity information about the relative velocity based on the velocity signal output from the velocity signal output circuit; perform a constant velocity discharge operation in which the liquid discharge head discharges the liquid from the nozzle while relative movement between the liquid discharge head and the certain medium at a constant relative velocity is performed; and perform an acceleration/deceleration discharge operation in which the liquid discharge head discharges the liquid while the relative movement between the liquid discharge head and the medium is performed so that the relative velocity increases or decreases. The velocity information includes a plurality of pieces of preceding velocity information. In the constant velocity discharge operation, the controller is configured to: obtain information about a representative value of the relative velocity based on the pieces of preceding velocity information; and determine a discharge timing of the liquid from the nozzle based on the information about the representative value. In the acceleration/deceleration discharge operation, the controller is configured to: obtain approximate information in which a change in the relative velocity is approximated based on distribution of the relative velocity indicated by the pieces of preceding velocity information; and determine a discharge timing of the liquid from the nozzle based on the approximate information.

According to the present disclosure, in the constant velocity discharge operation in which the relative movement between the liquid discharge head and the medium at the constant relative velocity is performed, the discharge timing can be determined appropriately based on the information about the representative value of the relative velocity obtained based on the plurality of pieces of preceding velocity information. Further, in the acceleration/deceleration discharge operation in which the relative movement between the liquid discharge head and the medium is performed so that the relative velocity increases or decreases, the discharge timing can be determined appropriately based on the approximate information in which the change in the relative velocity is approximated based on the distribution of the relative velocity indicated by the plurality of pieces of preceding velocity information.

DESCRIPTION OF THE EMBODIMENTS

An embodiment of the present disclosure is explained below.

Figure 1:
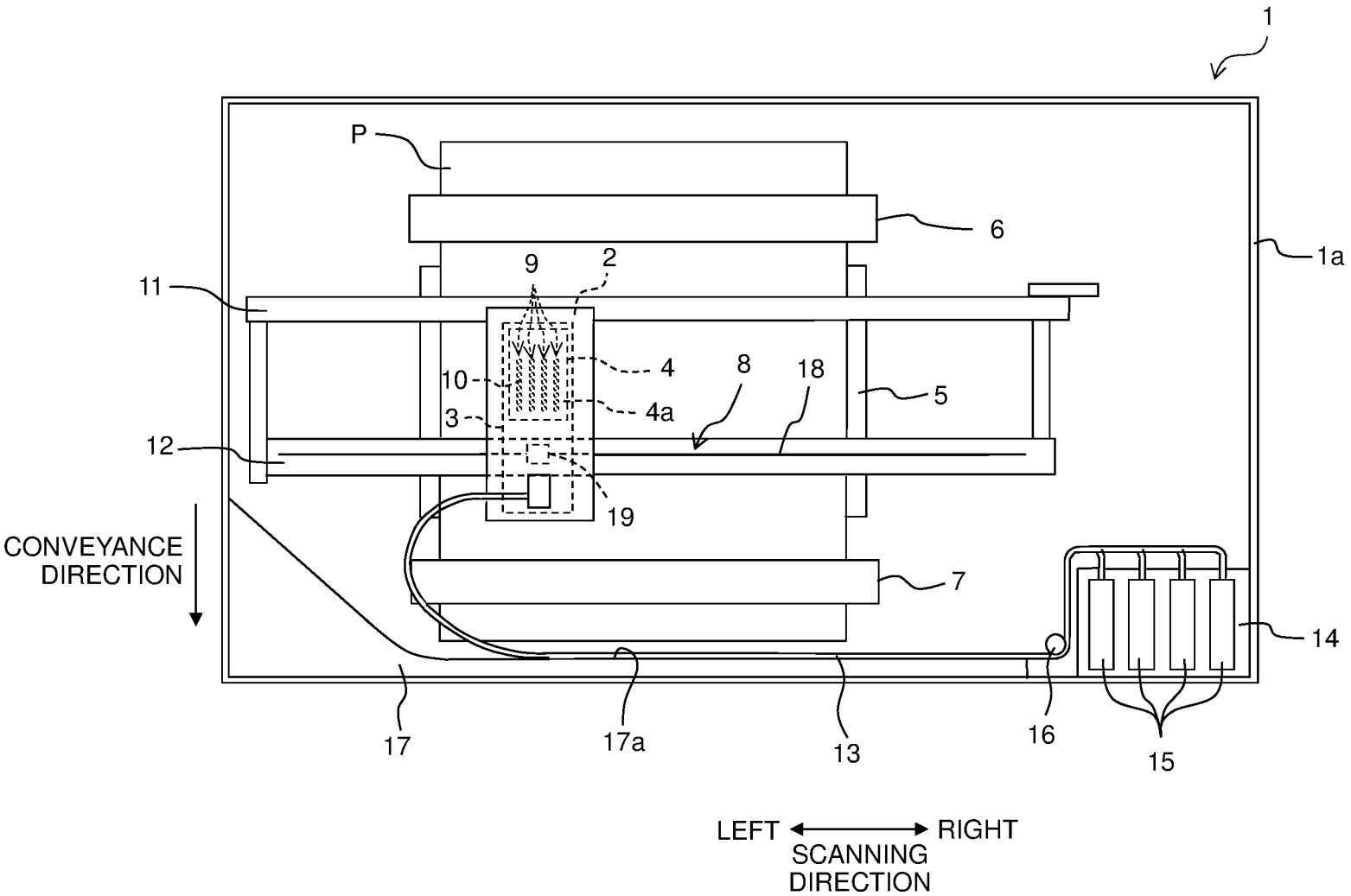
FIG. 1 depicts a schematic configuration of a printer 1.

As depicted in FIG. 1, a printer 1 according to this embodiment (a liquid discharge apparatus of the present disclosure) includes a carriage 2, a subtank 3, an ink-jet head 4 (a liquid discharge head of the present disclosure), a platen 5, conveyance rollers 6 and 7, a linear encoder 8 (a velocity signal output circuit of the present disclosure), and the like.

The carriage 2 is supported by two guide rails 11 and 12 extending in a scanning direction. The carriage 2 is connected to a carriage motor 56 (see FIG. 3) via a belt or the like (not depicted). Driving the carriage motor 56 moves the carriage 2 along the two guide rails 11 and 12 in the scanning direction. The following explanation is made by defining right and left sides in the scanning direction as indicated in FIG. 1.

The carriage 2 carries the subtank 3. In a casing 1*a* of the printer 1, a cartridge holder 14 is provided at the right side in the scanning direction and a downstream end in a conveyance direction of a recording sheet P (a medium of the present disclosure). The conveyance direction is orthogonal to the scanning direction. Four ink cartridges 15 (a liquid supply source of the present disclosure) are arranged in the scanning direction and removably installed in the cartridge holder 14. The ink cartridge 15 disposed on the rightmost side in the scanning direction contains a black ink, the second rightmost ink cartridge 15 contains a yellow ink, the third rightmost ink cartridge 15 contains a cyan ink, and the leftmost ink cartridge 15 contains a magenta ink. Each of the black, yellow, cyan, and magenta inks corresponds to a liquid of the present disclosure. The subtank 3 is connected to the four ink cartridges 15 installed in the cartridge holder 14 via four tubes 13. This allows the inks of four colors to be supplied from the four ink cartridges 15 to the subtank 3.

The four tubes 13 are made from a synthetic resin material having a relatively high rigidity, such as low-density polyethylene. The four tubes 13 extend from connection portions with the ink cartridges 15 along an edge of the cartridge holder 14 toward the left side in the scanning direction, and is bent toward the downstream side in the conveyance direction. Downstream ends in the conveyance direction of the portions extending in the conveyance direction of the four tubes 13 are fixed by a fixing member 16 arranged immediately at the left side in the scanning direction of the cartridge holder 14.

The four tubes 13 extend leftward in the scanning direction from the portions fixed by the fixing member 16, make a U-turn at an opposite side of the ink cartridges 15 in the scanning direction, and connected to the subtank 3. A wall 17 is provided at a downstream end in the conveyance direction of the casing 1*a* of the printer 1. The wall 17 extends in the scanning direction over an entire length of a movement range of the carriage 2. A wall surface 17*a* at an upstream side in the conveyance direction is brought into contact with the tubes 13 from the downstream side (the outside of the curve of the tubes 13) in the conveyance direction. The wall surface 17*a* of the wall 17 brought into contact with the tubes 13 extends substantially parallel to the scanning direction except for its left end. The left end of the wall surface 17*a* is inclined to the scanning direction such that the left end extends from the downstream side to the upstream side in the conveyance direction from the right side to the left side in the scanning direction.

The ink-jet head 4 is carried on the carriage 2, and is connected to a lower end of the subtank 3. In this configuration, the ink-jet head 4 is connected to the ink cartridges 15 via the tubes 13 and the subtank 3. The inks of four colors are supplied from the subtank 3 to the ink-jet head 4. The ink-jet head 4 discharges inks from nozzles 10 formed in a nozzle surface 4*a*, which is a lower surface of the ink-jet head 4 and parallel to the scanning direction and the conveyance direction. More specifically, the nozzles 10 are arranged in the conveyance direction to form four nozzle rows 9. The ink-jet head 4 includes four nozzle rows 9 arranged in the scanning direction. The black ink is discharged from the nozzles 10 belonging to the rightmost nozzle row 9 in the scanning direction, the yellow ink is discharged from the nozzles 10 belonging to the second rightmost nozzle row 9, the cyan ink is discharged from the nozzles 10 belonging to the third rightmost nozzle row 9, and the magenta ink is discharged from the nozzles 10 belonging to the leftmost nozzle row 9.

The platen 5 is disposed below the ink-jet head 4 to face the nozzles 10. The platen 5 extends over an entire length in the scanning direction of the recording sheet P and supports the recording sheet P from below. The conveyance roller 6 is disposed upstream of the ink-jet head 4 and the platen 5 in the conveyance direction. The conveyance roller 7 is disposed downstream of the ink-jet head 4 and the platen 5 in the conveyance direction. The conveyance rollers 6 and 7 are connected to the conveyance motor 57 (see FIG. 3) via a gear or the like (not depicted). Driving the conveyance motor 57 rotates the conveyance rollers 6 and 7, thus conveying the recording sheet P in the conveyance direction.

Figure 2A:
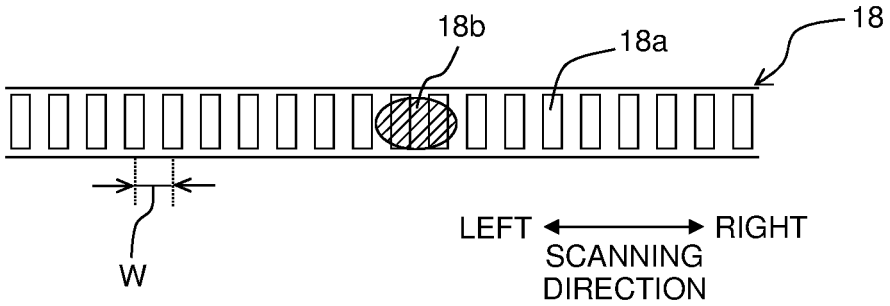
FIG. 2A depicts an encoder scale in FIG. 1 when seen from a downstream side in a conveyance direction.

The linear encoder 8 includes an encoder scale 18 and an encoder sensor 19. The encoder scale 18 is disposed on the guide rail 12. The encoder scale 18 extends in the scanning direction over a substantially entire length of the guide rail 12. As depicted in FIG. 2A, the encoder scale 12 includes slits 18*a* (a detection target of the present disclosure) having transmissivity that are arranged at regular intervals W in the scanning direction.

Figure 2B:
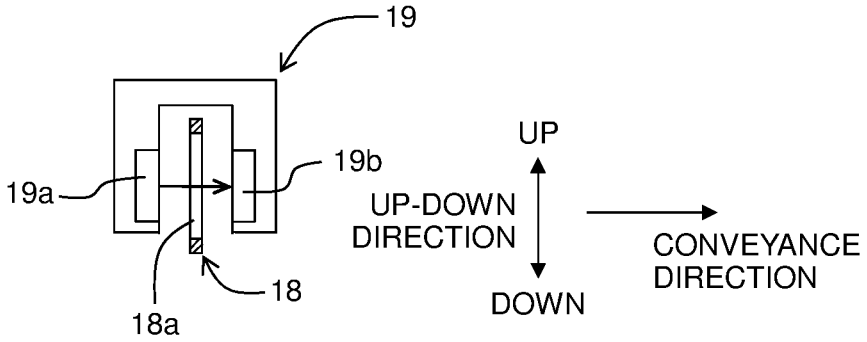
FIG. 2B depicts the encoder scale and an encoder sensor in a state where the encoder sensor faces a slit of the encoder scale when seen from a left side in a scanning direction.
Figure 2C:
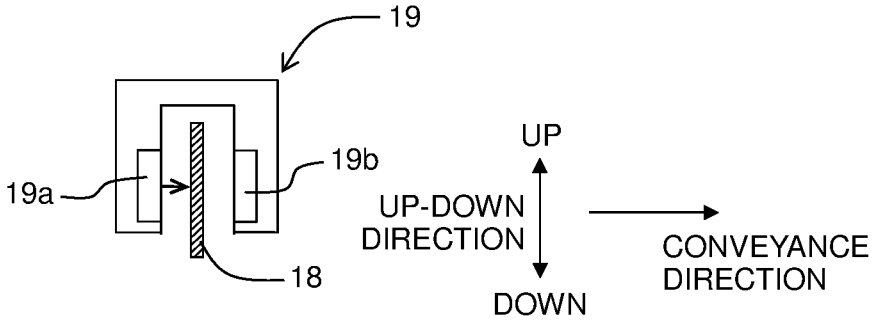
FIG. 2C depicts the encoder scale and the encoder sensor in a state where the encoder sensor does not face the slit of the encoder scale when seen from the left side in the scanning direction.

The encoder sensor 19 is carried on the carriage 2. As depicted in FIGS. 2B and 2C, the encoder sensor 19 includes a light emitting element 19*a* and a light receiving element 19*b*. The light emitting element 19*a* faces the light receiving element 19*b* in the conveyance direction. The encoder scale 18 is disposed between the light emitting element 19*a* and the light receiving element 19*b* in the conveyance direction so that the light emitting element 19*a* and the light receiving element 19*b* face the encoder scale 18. The light emitting element 19*a* emits light toward the light receiving element 19*b*.

The encoder sensor 19 (light emitting element 19*a* and light receiving element 19*b*) may be positioned in the same position as the slit 18*a* of the encoder scale 18 in the scanning direction. In this case, as depicted in FIG. 2B, the light emitted from the light emitting element 19*a* passes through the slit 18*a* and is received by the light receiving element 19*b*. On the other hand, the encoder sensor 19 (light emitting element 19*a* and light receiving element 19*b*) may be positioned in a position between two adjacent slits 18*a* of the encoder scale 18 in the scanning direction. In that case, as depicted in FIG. 2C, the light emitted from the light emitting element 19*a* is not received by the light receiving element 19*b* by being blocked by the encoder scale 18. The encoder sensor 19 outputs a signal indicating whether light is received by the light receiving element 19*b*.

When the carriage 2 moves in the scanning direction, a state of the encode sensor 19 alternately changes between a state where light is received by the light receiving element 19*b* and a state where light is not received by the light receiving element 19*b*. In this configuration, information about a position in the scanning direction of the carriage 2 can be obtained based on the counts of the light received by the light receiving element 19*b*. The number of the counts of the light corresponds to the number of the slits 18*a* facing the encoder sensor 19. Further, velocity information about a moving velocity of the carriage 2 (a relative velocity between the ink-jet head 4 and the recording sheet P) can be obtained based on the counts of the light received by the light receiving element 19*b* per unit time. Namely, in this embodiment, the encoder sensor 19 of the linear encoder 8 outputs a velocity signal related to the moving velocity of the carriage 2.

Figure 3:
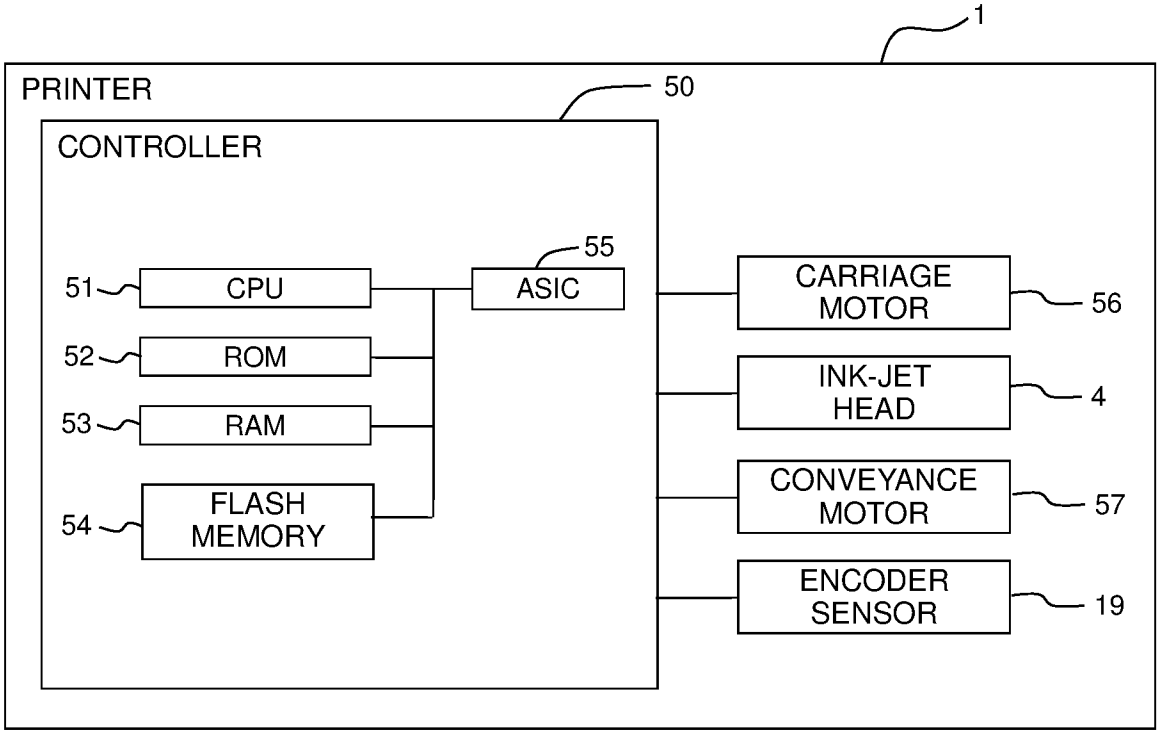
FIG. 3 is a block diagram of an electrical configuration of the printer 1.

Next, an electrical configuration of the printer 1 is explained below. The operation of the printer 1 is controlled by the controller 50. As depicted in FIG. 3, the controller 50 includes a Central Processing Unit (CPU) 51, a Read Only Memory (ROM) 52, a Random Access Memory (RAM) 53, a flash memory 54, an Application Specific Integrated Circuit (ASIC) 55, and the like. The controller 50 controls operations of the carriage motor 56, the ink-jet head 4, the conveyance motor 57, and the like. The signal from the encoder sensor 19 is input to the controller 50. The controller 50 obtains the information about the position in the scanning direction of the carriage 2 and the velocity information about the moving velocity of the carriage 2 based on the input signal.

<Control in Recording>

Subsequently, the control when the printer 1 performs recording on the recording sheet P is explained. The printer 1 performs recording on the recording sheet P by alternately repeating a recording pass and a conveyance operation. In the recording pass, the controller 50 controls the ink-jet head 4 to discharge ink from the nozzles 10 on the recording sheet P while controlling the carriage motor 56 to move the carriage 2 in the scanning direction. In the conveyance operation, the controller 50 controls the conveyance motor 57 to convey the recording sheet P by use of the conveyance rollers 6 and 7. In this embodiment, when the carriage 2 moves in the scanning direction in the recording pass, the ink-jet head 4 carried on the carriage 2 moves relatively to the recording sheet P in the scanning direction (one direction of the present disclosure).

Figure 4:
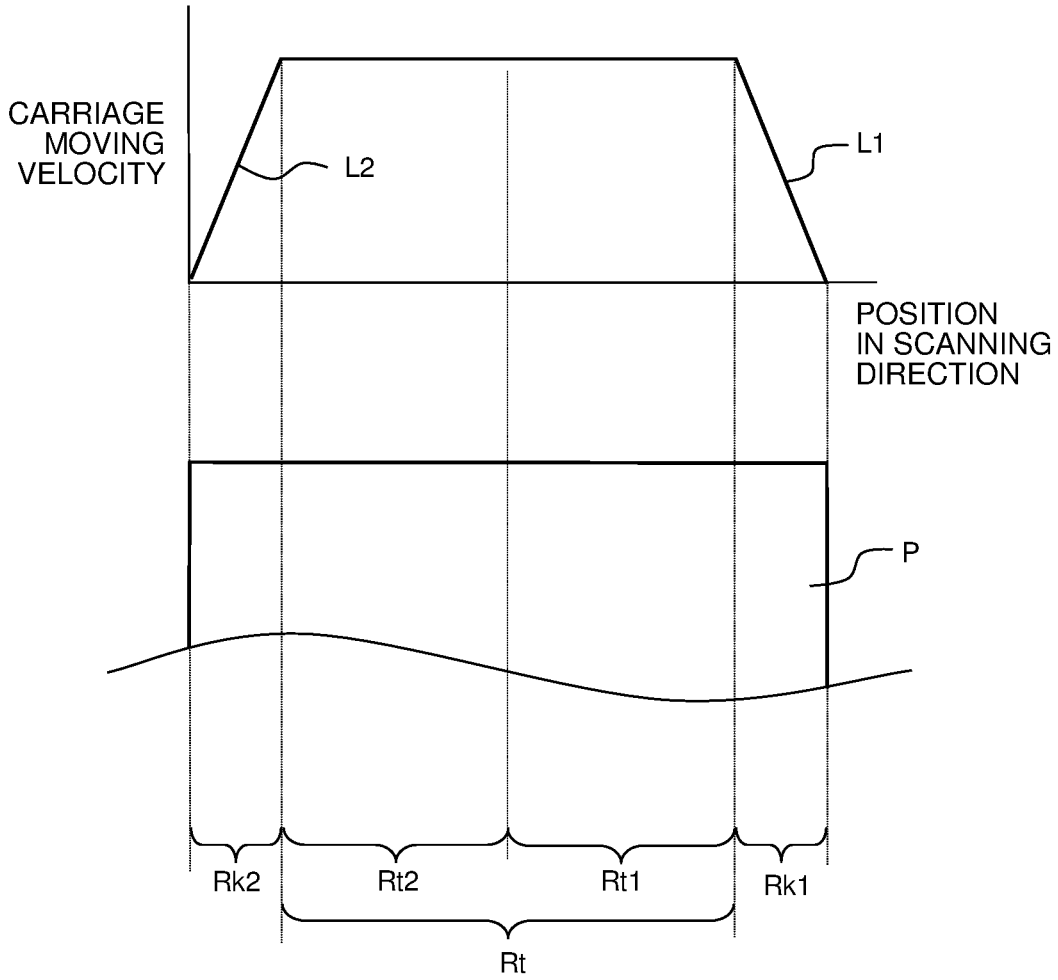
FIG. 4 illustrates a relationship between a position in the scanning direction and a moving velocity of a carriage in a recording pass.

As depicted in FIG. 4, when the carriage 2 moves leftward in the scanning direction in the recording pass, the carriage 2 accelerates in a right acceleration/deceleration area Rk1 (hereinafter simply referred to as an area Rk1 in some cases), moves at a constant moving velocity in a constant velocity area Rt (hereinafter simply referred to as an area Rt in some cases) that is adjacent to the left side of the area Rk1, and decelerates in a left acceleration/deceleration area Rk2 (hereinafter simply referred to as an area Rk2 in some cases) that is adjacent to the left side of the area Rt. When the carriage 2 moves rightward in the scanning direction in the recording pass, the carriage 2 accelerates in the area Rk2, moves at the constant moving velocity in the area Rt, and decelerates in the area Rk1.

As depicted in FIG. 4, in the printer 1, the ink-jet head 4 faces the recording sheet P when the carriage 2 is positioned in any of the areas Rt, Rk1 and Rk2. In the recording pass, ink is discharged from nozzles 10 of the ink-jet head 4 when the carriage 2 is positioned in any of the areas Rt, Rk1 and Rk2. The state where the carriage 2 is positioned in the area Rt means that the carriage 2 is positioned so that a specific portion (e.g., a center portion in the scanning direction) of the ink-jet head 4 is in the area Rt. Similarly, the state where the carriage 2 is positioned in the area Rk1, Rk2 means that the carriage 2 is positioned so that the specific portion of the ink-jet head 4 is in the area Rk1, Rk2.

In this embodiment, when the carriage 2 is positioned in the area Rt, the controller 50 causes the ink-jet head 4 to discharge ink from the nozzles 10 while moving the carriage 2 at the constant moving velocity. This operation included in the recording pass corresponds to a constant-velocity discharge operation of the present disclosure. Further, when the carriage 2 is in the area Rk1, Rk2, the controller 50 causes the ink-jet head 4 to discharge ink from the nozzles 10 while accelerating or decelerating the carriage 2. This operation included in the recording pass corresponds to an acceleration/deceleration discharge operation of the present disclosure.

In the recording pass, the controller 50 obtains the information about the moving velocity of the carriage 2 based on the signal from the encoder sensor 19. The controller 50 controls a rotational velocity of the carriage motor 56 so that the moving velocity of the carriage 2 indicated by the information comes close to the moving velocity of the carriage 2 indicated in FIG. 4. Accordingly, the controller 50 controls the moving velocity of the carriage 2.

<Process for Determining Discharge Timing>

Subsequently, a series of processes for determining a discharge timing at which ink is discharged from the nozzles 10 in the recording pass is explained. In the recording pass, for example, ink lands on the recording sheet P at regular intervals in the scanning direction. In the recording process, ink is required to be discharged from the nozzles 10 at an appropriate discharge timing so that ink lands on appropriate positions on the recording sheet P. Further, the landing positions of ink in the scanning direction on the recording sheet P when ink is discharged from the nozzles 10 at a certain discharge timing vary depending on the moving velocity of the carriage 2. Thus, in the printer 1, the moving velocity of the carriage 2 is inferred as described below in detail, and the discharge timing is determined based on the inferred moving velocity of the carriage 2. In the recording pass, ink is discharged from the nozzles 10 at the determined discharge timing.

Figure 5:
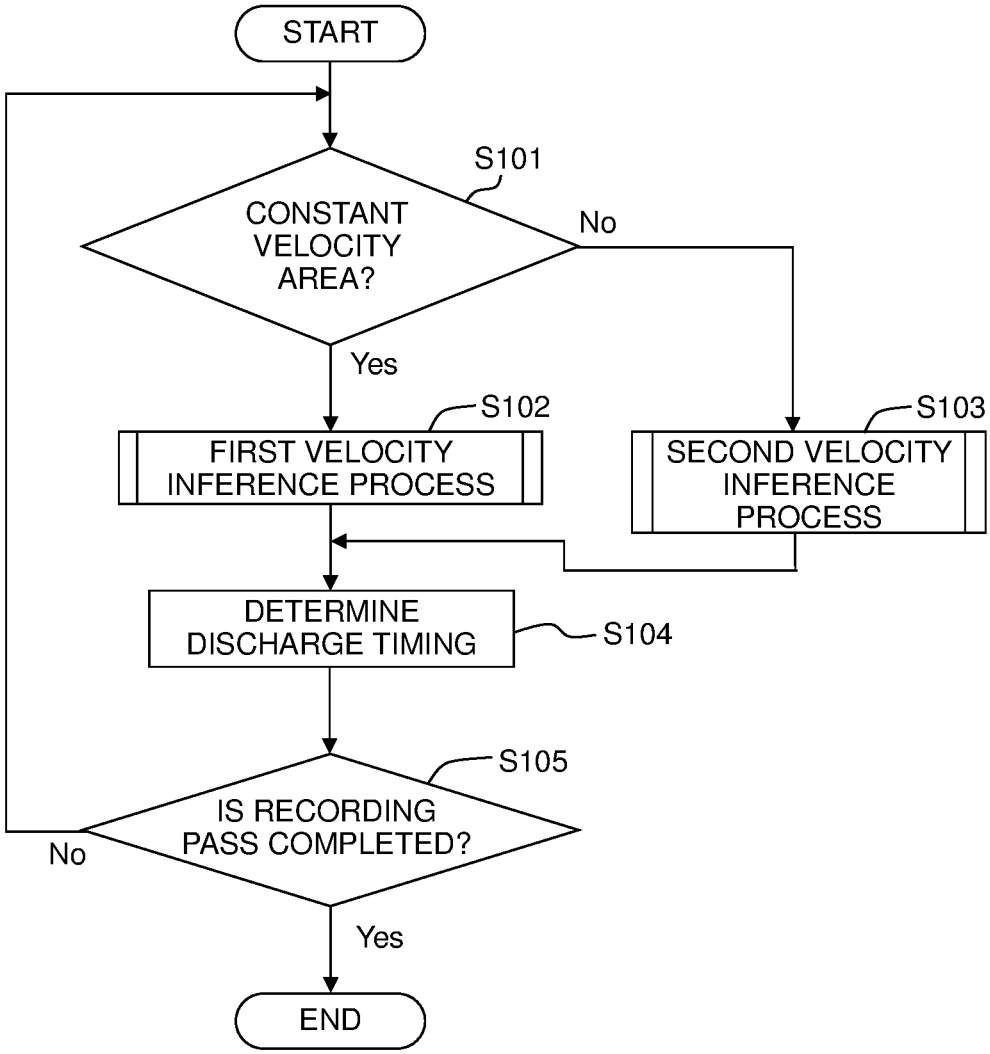
FIG. 5 depicts a flowchart indicating processes for determining a discharge timing in the recording pass.

In the printer 1, the controller 50 determines the discharge timing in the recording pass by performing the processes in accordance with the flowchart of FIG. 5. The flowchart of FIG. 5 starts when the recording pass starts. More specifically, when the carriage 2 is positioned in the area Rt (S101: YES), the controller 50 infers the moving velocity of the carriage 2 by a first velocity inference process (S102). When the carriage 2 is positioned in the area Rk1, Rk2 (S101: NO), the controller 50 infers the moving velocity of the carriage 2 by a second velocity inference process (S103).

<First Velocity Inference Process>

Figure 6:
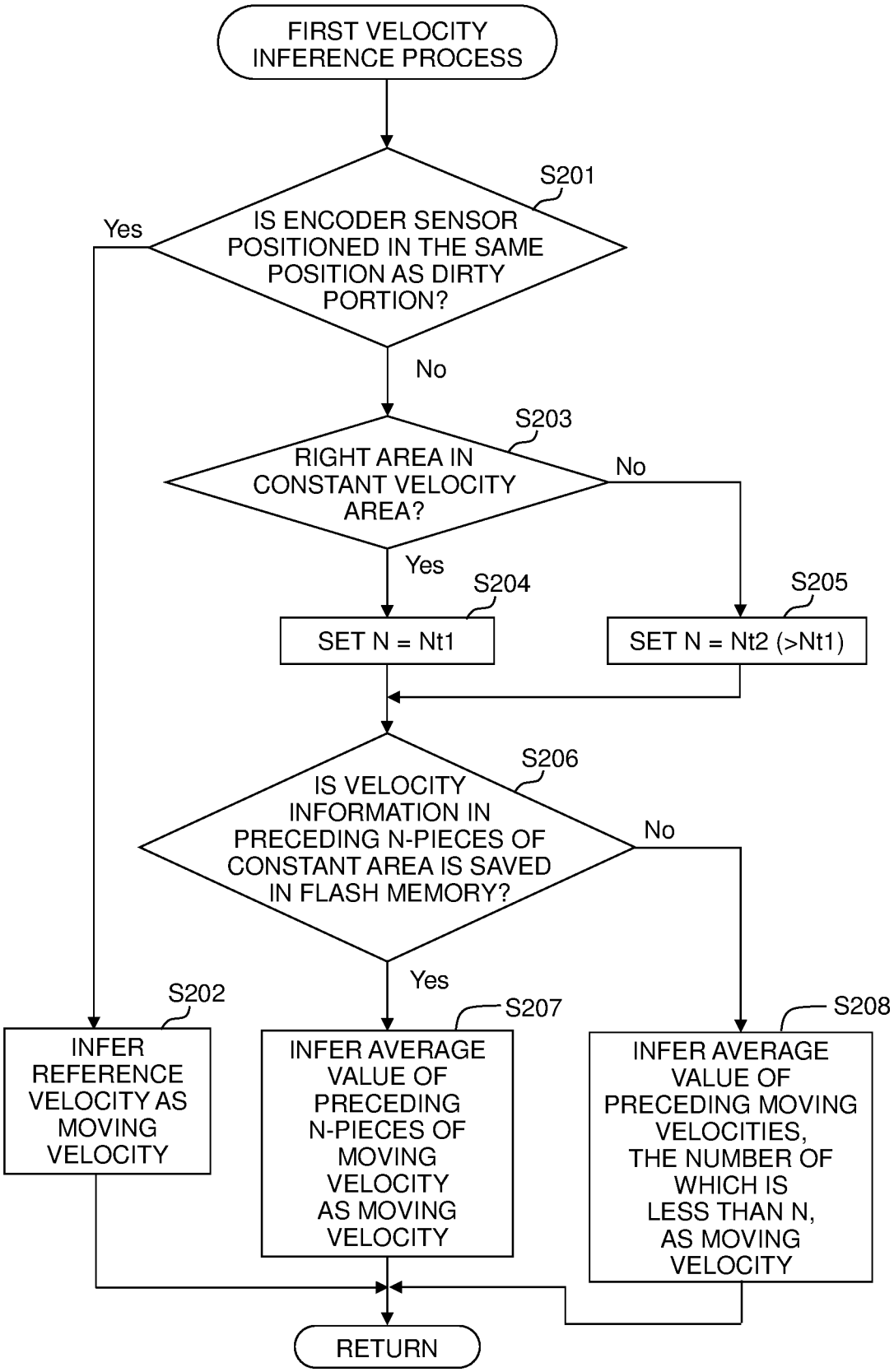
FIG. 6 depicts a flowchart indicating a first velocity inference process in FIG. 5.

In the first velocity inference process of S102, as indicated in FIG. 6, the controller 50 determines whether the encoder sensor 19 is positioned in the same position as a dirty portion 18*b* of the encoder scale 18 in the scanning direction (S201). The dirty portion 18*b* means a portion of the encoder scale 18 at which the slit 18*a* is clogged with dirt adhered thereto, as depicted in FIG. 2A.

The dirty portion 18*b* is caused, for example by the ink adhered to the encoder scale 18 in the past recording for the recording sheet P. In this embodiment, when no recording is performed on the recording sheet P, the carriage 2 moves in the scanning direction. On this occasion, the position in the scanning direction of the dirty portion 18*b* is obtained based on the signal output from the encoder sensor 19 and the information is saved in the flash memory 54 (a memory of the present disclosure). The information may be saved in the flash memory 54 as information about the position in the scanning direction of the dirty portion 18*b*, or may be saved in the flash memory 54, for example, as information about a position where a detection error, in which the encoder sensor 19 can not detect the slit 18*a*, is caused.

When the encoder sensor 19 is in the same position as the dirty portion 18*b* in the scanning direction (S201: YES), the controller 50 infers a reference velocity as the moving velocity of the carriage 2 (S202). Then, the controller 50 returns to the flowchart of FIG. 5. The reference velocity is a moving velocity of the carriage 2 set in advance. Information about the reference velocity is saved in the flash memory 54. In this embodiment, the information about the reference velocity corresponds to "reference velocity information" of the present disclosure.

When the encoder sensor 19 is not in the same position as the dirty portion 18*b* in the scanning direction (S201: NO), the controller 50 determines (S203) whether the carriage 2 is positioned in a right area Rt1 that is a right half portion in the scanning direction of the area Rt, as depicted in FIG. 4. In this embodiment, the position in the scanning direction within the right area Rt1 corresponds to a second constant velocity position of the present disclosure.

When the carriage 2 is in the right area Rt1 (S203: YES), the controller 50 sets a predefined number N to Nt1, which is equal to or more than two (S204). When the carriage 2 is positioned in a left area Rt2 that is a left half portion in the scanning direction of the area Rt (S203: NO) as depicted in FIG. 4, the controller 50 sets the predefined number N to Nt2, which is larger than Nt1 (S205). In this embodiment, the position in the scanning direction within the left area Rt2 corresponds to a first constant velocity position of the present disclosure.

After setting the predefined number N in S204 or S205, the controller 50 determines whether velocity information in preceding N-pieces of area Rt (hereinafter simply referred to as preceding N-areas Rt) is saved in the flash memory 54 (S206). For example, the velocity information in the preceding N-areas Rt is saved in the flash memory 54 after the carriage 2 moves some distance since the start of the movement at the constant moving velocity. On the other hand, for example, the velocity information in the preceding N-areas Rt is not saved in the flash memory 54 immediately after the carriage 2 starts the movement at the constant moving velocity.

When the velocity information in the preceding N-areas Rt is saved in the flash memory 54 (S206: YES), the controller 50 infers an average value (a representative value of the present disclosure) of the movement velocities indicated by the velocity information in the preceding N-areas Rt, as the moving velocity of the carriage 2 (S207). Then, the controller 50 returns to the flowchart of FIG. 5. When the velocity information in the preceding N-areas Rt is not saved in the flash memory 54 (S206: NO), the controller 50 infers an average value of the movement velocities indicated by the velocity information in all the preceding areas Rt, the number of which is less than N, as the moving velocity of the carriage 2 (S208). Then, the controller 50 returns to the flowchart of FIG. 5. Here, "the velocity information in all the preceding areas Rt, the number of which is less than N" means all the Nx pieces of velocity information, for example, when only Nx pieces (Nx<N) of velocity information in the preceding areas Rt is saved in the flash memory 54. In this embodiment, inferring the average value of the movement velocities in S207 or S208 as the moving velocity of the carriage 2 corresponds to "obtaining information about a representative value" of the present disclosure.

<Second Velocity Inference Process>

Figure 7A:
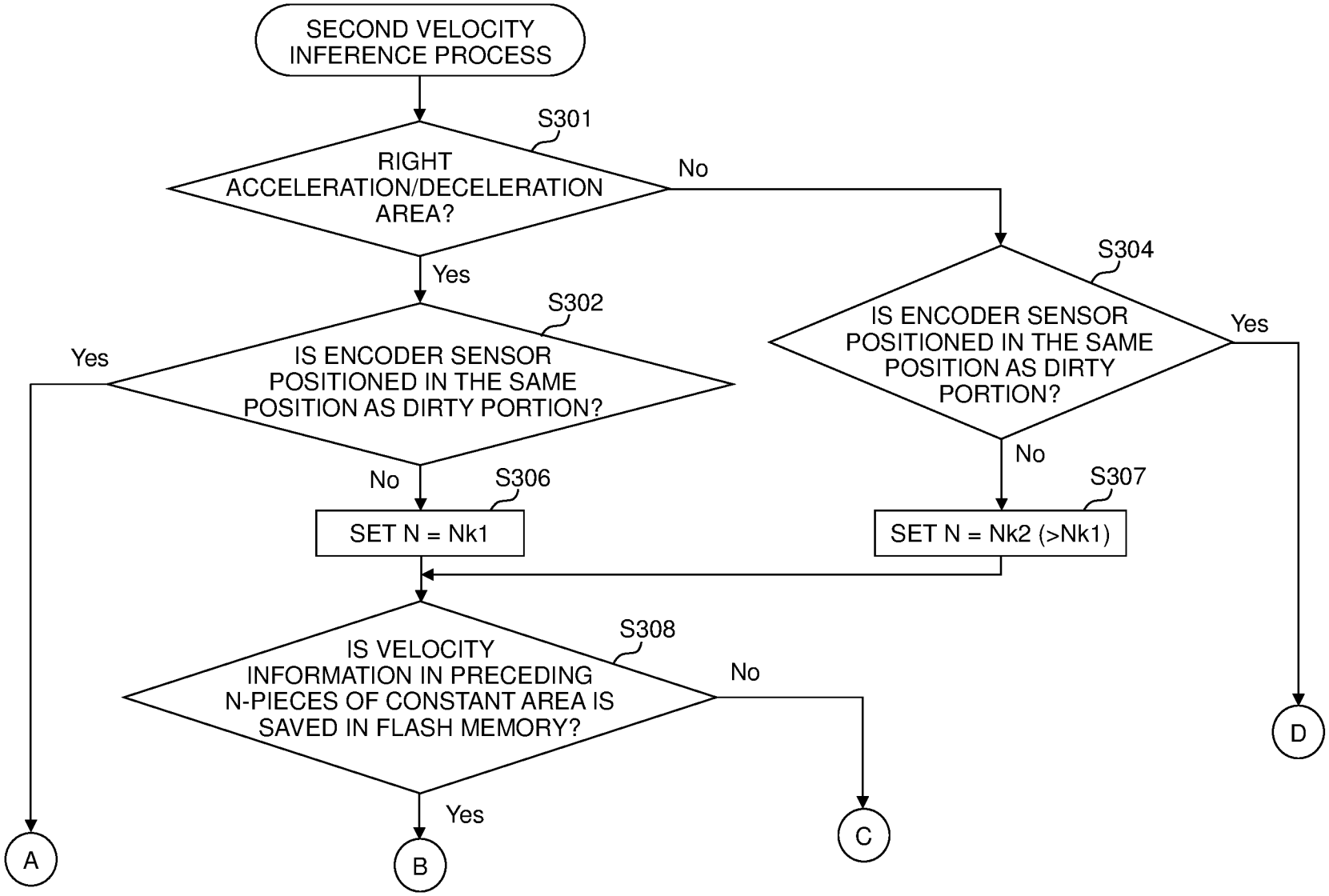
FIGS. 7A and 7B depict a flowchart indicating a second velocity inference process in FIG. 5.
Figure 7B:
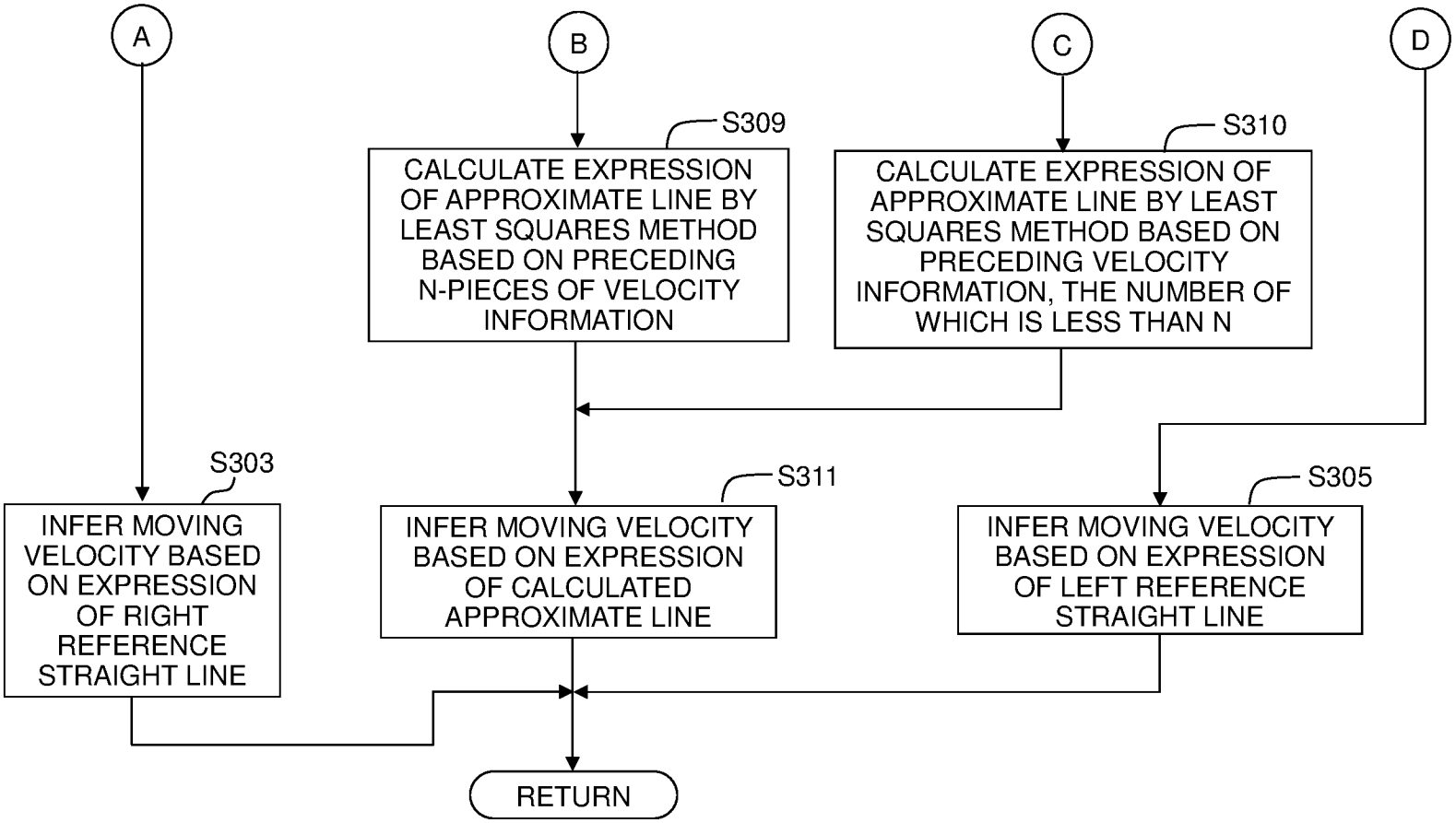

In the second velocity inference process of S103, as indicated in FIGS. 7A and 7B, when the carriage 2 is positioned in the area Rk1 (S301: YES), and when the encoder sensor 19 is in the same position as the dirty portion 18*b* in the scanning direction (S302: YES), the controller 50 infers the moving velocity of the carriage 2 (S303) based on an expression of a right reference straight line, and returns to the flowchart of FIG. 5. The expression of the right reference straight line is, for example, an expression of a straight line indicating a change in moving velocity of the carriage 2 that is set in advance depending on an acceleration rate of the carriage 2 in the area Rk1, such as an expression of a straight line L1 in FIG. 4. Information about the expression of the straight line is saved in the flash memory 54.

When the carriage 2 is positioned in the area Rk2 (S301: NO), and when the encoder sensor 19 is in the same position as the dirty portion 18*b* in the scanning direction (S304: YES), the controller 50 infers the moving velocity of the carriage 2 (S305) based on an expression of a left reference straight line, and returns to the flowchart of FIG. 5. The expression of the left reference straight line is, for example, an expression of a straight line indicating a change in moving velocity of the carriage 2 that is set in advance depending on an acceleration rate of the carriage 2 in the area Rk2. Information about the expression of the straight line is saved in the flash memory 54.

In this embodiment, the information about the expression of the right reference straight line and the information about the expression of the left reference straight line correspond to reference velocity change information of the present disclosure.

When the carriage 2 is positioned in the area Rk1 (S301: YES), and when the encoder sensor 19 is not in the same position as the dirty portion 18*b* in the scanning direction (S302: NO), the controller 50 sets the predefined number N to Nk1, which is equal to or more than two (S306). When the carriage 2 is positioned in the area Rk2 (S301: NO), and when the encoder sensor 19 is not in the same position as the dirty portion 18*b* in the scanning direction (S304: NO), the controller 50 sets the predefined number N to Nk2, which is larger than Nk1 (S307).

In this embodiment, the position in the scanning direction within the area Rk1 corresponds to a second acceleration/deceleration position of the present disclosure, and the position in the scanning direction within the area Rk2 corresponds to a first acceleration/deceleration position of the present disclosure.

After setting the predefined number N in S306 or S307, the controller 50 determines whether the velocity information in preceding N pieces of area Rk1 or preceding N pieces of area Rk2 (hereinafter simply referred to as preceding N-areas Rk1 or preceding N-areas Rk2) is saved in the flash memory 54 (S308). For example, after the carriage 2 moves some distance since the start of the acceleration or deceleration, the velocity information in the preceding N-areas Rk1 or the preceding N-areas Rk2 is saved in the flash memory 54. On the other hand, for example, immediately after the acceleration or deceleration of the carriage 2 starts, the velocity information in the preceding N-areas Rk1 or the preceding N-areas Rk2 is not saved in the flash memory 54.

Figure 7C:
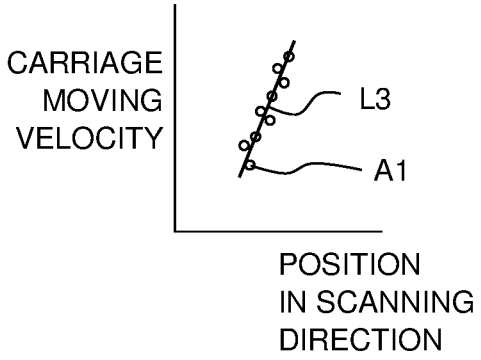
FIG. 7C depicts an example of the approximate line L3 when the carriage 2 accelerates.

When the velocity information in the preceding N-areas Rk1 or the preceding N-areas Rk2 is saved in the flash memory 54 (S308: YES), as indicated in FIG. 7C, the controller 50 calculates an expression of an approximate line L3 indicating a change in moving velocity of the carriage 2 that is approximated by a least squares method based on the distribution of the moving velocities of the carriage 2 indicated by the velocity information in the preceding N-areas Rk1 or the preceding N-areas Rk2 (S309). In FIG. 7C, the distribution of plot points A1 corresponds to the distribution of the moving velocities of the carriage 2 indicated by the velocity information in the preceding N-areas Rk1 or the preceding N-areas Rk2. Although FIG. 7C depicts an example of the approximate line L3 when the carriage 2 accelerates, the inclination of the approximate line L3 is reversed to that in FIG. 7C when the carriage 2 decelerates.

Figure 7D:
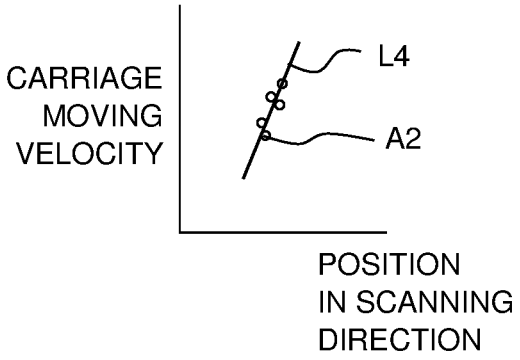
FIG. 7D depicts an example of the approximate line L4 when the carriage 2 accelerates.

When the velocity information in the preceding N-areas Rk1 or the preceding N-areas Rk2 is not saved in the flash memory 54 (S308: NO), as indicated in FIG. 7D, the controller 50 calculates an expression of an approximate line L4 indicating a change in moving velocity of the carriage 2 that is approximated by the least squares method based on the distribution of the moving velocities of the carriage 2 indicated by the velocity information in all the preceding areas Rk1, the number of which is less than N, or all the preceding areas Rk2, the number of which is less than N (S310). Here, "velocity information in all the preceding areas Rk1, the number of which is less than N, or all the preceding areas Rk2, the number of which is less than N" means all the pieces of velocity information in Nx pieces of area Rk1, Rk2, for example, when only Nx pieces (Nx<N) of the velocity information in the preceding areas Rk1, Rk2 are saved in the flash memory 54. In FIG. 7D, the distribution of plot points A2 corresponds to the distribution of the moving velocities of the carriage 2 indicated by the velocity information in the preceding areas Rk1, the number of which is less than N, or the preceding areas Rk2, the number of which is less than N. Although FIG. 7D depicts an example of the approximate line L4 when the carriage 2 accelerates, the inclination of the approximate line L4 is reversed to that in FIG. 7D when the carriage 2 decelerates.

In this embodiment, the information about the expression of the approximate line L3, L4 corresponds to approximate information of the present disclosure. Calculating the expression of the approximate line L3, L4 corresponds to "obtaining approximate information" of the present disclosure. Then, the controller 50 infers the moving velocity of the carriage 2 based on the expression of the approximate line L3, L4 calculated in S309, S310 (S311), and returns to the flowchart of FIG. 5.

Returning to FIG. 5, after referring the moving velocity of the carriage 2 in the first velocity inference process of S102 or the second velocity inference process of S103, the controller 50 determines the discharge timing based on the inferred moving velocity of the carriage 2 (S104).

Figure 8A:
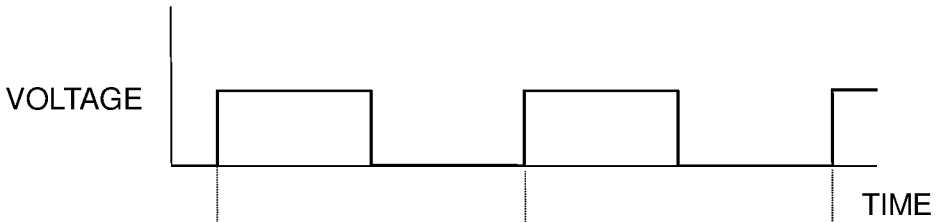
FIG. 8A illustrates a signal output from the encoder sensor.
Figure 8B:
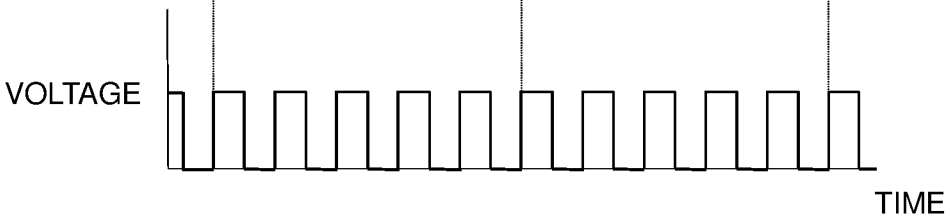
FIG. 8B illustrates a multiplication signal obtained by multiplying a frequency of the signal of FIG. 8A.

In S104, a frequency of the signal output from the encoder sensor 19 as depicted in FIG. 8A is multiplied to generate a multiplication signal as depicted in FIG. 8B, and the multiplication signal is corrected based on the inferred moving velocity of the carriage 2. Then, the discharge timing is determined based on the corrected multiplication signal. The multiplication signal is corrected, for example, so that the discharge timing is later as the inferred moving velocity of the carriage 2 is slower. FIG. 8B depicts the multiplication signal obtained when the frequency of the signal from the encoder sensor 19 is multiplied fivefold.

Thus, when the moving velocity of the carriage 2 is inferred in S207 or S208, the multiplication signal is corrected based on the average value of the moving velocities of the carriage 2 indicated by a plurality of pieces of preceding velocity information. The discharge timing is determined based on the corrected signal. When the moving velocity of the carriage 2 is inferred in S311, the multiplication signal is corrected based on the expression of the approximate line (the approximate information of the present disclosure) calculated in S309 or S310, and the discharge timing is determined based on the corrected signal.

In the printer 1, the multiplication signal obtained by multiplying the frequency of the signal output from the encoder sensor 19 is corrected based on the moving velocity of the carriage 2, and a plurality of continuous discharge timings are determined based on the corrected multiplication signal. This allows ink to land on the recording sheet P at intervals shorter than the interval W between the slits 18*a* of the encoder scale 18 in the scanning direction.

The controller 50 repeats the processes of S101 to S104 after the discharge timing is determined in S104 until the recording pass is completed (S105: NO). The series of processes is completed when the recording pass is completed (S105: YES).

<Effect>

In this embodiment, in the recording pass, when the carriage 2 is positioned in the area Rt where the carriage 2 moves at the constant moving velocity, the controller 50 infers the average value of the moving velocities of the carriage 2 indicated by the plurality of pieces of preceding velocity information as the moving velocity of the carriage 2. Thus, it is possible to accurately infer the moving velocity of the carriage 2 when the carriage 2 moves at the constant moving velocity, and it is possible to appropriately determine the discharge timing based on the inferred moving velocity of the carriage 2.

In the recording pass, when the carriage 2 is positioned in the area Rk1 or the area Rk2 where the carriage 2 accelerates or decelerates, the expression of the approximate line indicating the change in moving velocity of the carriage 2 that is approximated by the least squares method is calculated based on the distribution of the moving velocities of the carriage 2 indicated by the plurality of pieces of preceding velocity information. The moving velocity of the carriage 2 is inferred based on the expression of the approximate line. This allows the controller 50 to accurately infer the moving velocity of the carriage 2 when the carriage 2 accelerates or decelerates, and to appropriately determine the discharge timing based on the inferred moving velocity of the carriage 2.

Figure 9A:
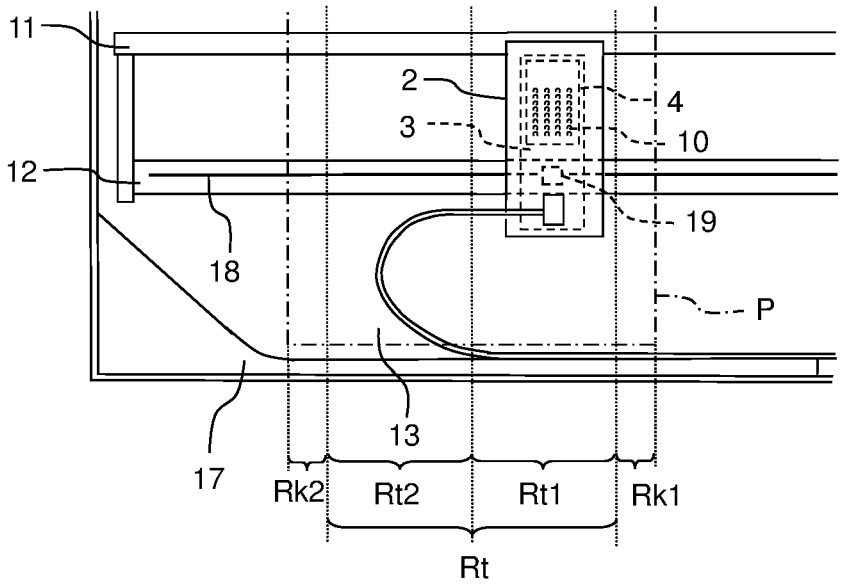
FIG. 9A illustrates a tube when the carriage is positioned in a right area in a constant velocity area.
Figure 9B:
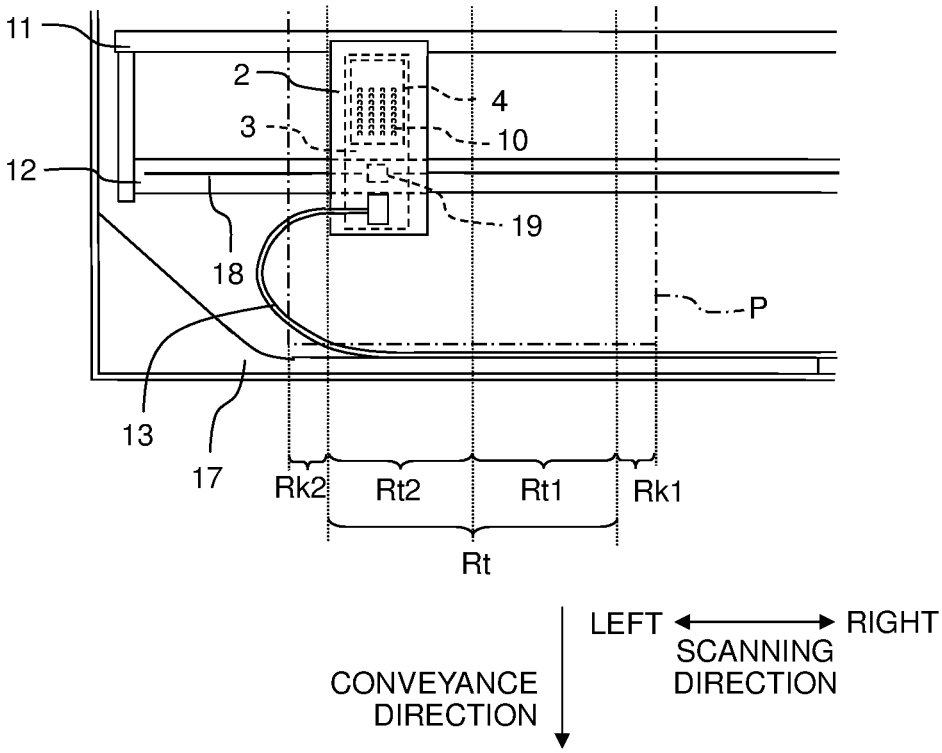
FIG. 9B illustrates the tube when the carriage is positioned in a left area in the constant velocity area.

In this embodiment, the wall 17 is brought into contact with the curved tubes 13 from the outside of the curve. Further, in a state where the carriage 2 is positioned in the left area Rt2 as depicted in FIG. 9B, the length of a portion of each tube 13 brought into contact with the wall 17 is longer than a case where the carriage 2 is positioned in the right area Rt1 as depicted in FIG. 9A. Thus, in the state where the carriage 2 is positioned in the left area Rt2, the degree of curve of the tubes 13 is higher than the case where the carriage 2 is positioned in the right area Rt1, and the force applied from the tubes 13 to the carriage 2 is large.

Thus, when the carriage 2 is positioned in the left area Rt2, the force applied from the tubes 13 is more likely to change the moving velocity of the carriage 2 rapidly than the case where the carriage 2 is positioned in the right area Rt1. When an average value of the moving velocities of the carriage 2 indicated by few pieces of preceding velocity information is inferred as the moving velocity of the carriage 2 in the state where the moving velocity of the carriage 2 is likely to change rapidly, the inferred moving velocity of the carriage 2 may be affected by the rapid change in moving velocity of the carriage 2. As a result, when the discharge timing is determined based on the inferred moving velocity of the carriage 2, the ink landing position in the scanning direction may greatly shift from an ideal position.

In view of the above, in this embodiment, when the carriage 2 is positioned in the left area Rt2, an average value of the moving velocities of the carriage 2 indicated by more pieces of velocity information than the case where the carriage 2 is positioned in the right area Rt1 is inferred as the moving velocity of the carriage 2. Thus, when the carriage 2 is positioned in the left area Rt2 where the force from the tubes 13 is likely to change the moving velocity of the carriage 2 rapidly, the effect of the rapid change in the moving velocity of the carriage 2 on the average value is small. Namely, the inferred moving velocity of the carriage 2 is not likely to be affected by the rapid change in the moving velocity of the carriage 2 due to the force from the tubes 13. As a result, it is possible to appropriately determine the discharge timing based on the inferred moving velocity of the carriage 2.

When the carriage 2 is positioned in the right area Rt1 where the force from the tubes 13 is not likely to change the moving velocity of the carriage 2 rapidly, an average value of the moving velocities of the carriage 2 indicated by fewer pieces of preceding velocity information is inferred as the moving velocity of the carriage 2. Accordingly, the moving velocity of the carriage 2 is inferred based on preceding velocity information. It is thus possible to determine the discharge timing appropriately based on the inferred moving velocity of the carriage 2.

Figure 10A:
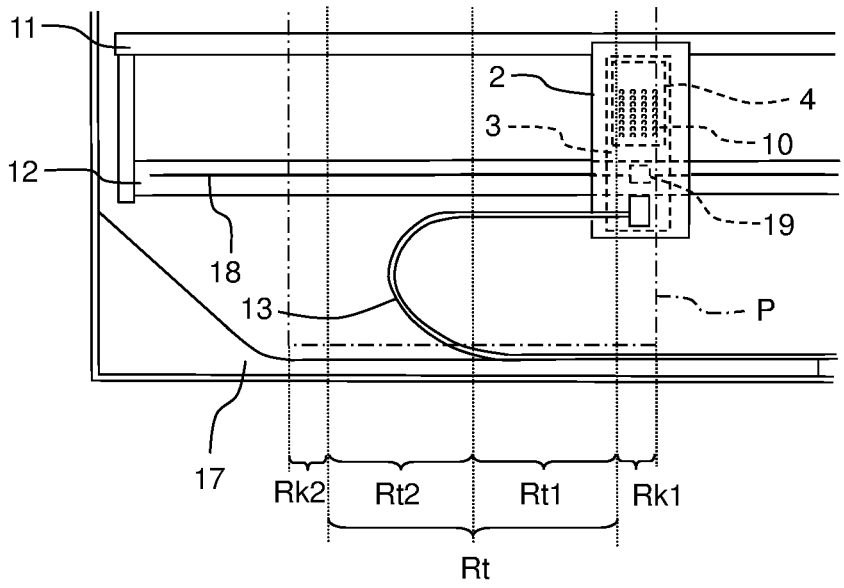
FIG. 10A illustrates the tube when the carriage is positioned in a right acceleration/deceleration area.
Figure 10B:
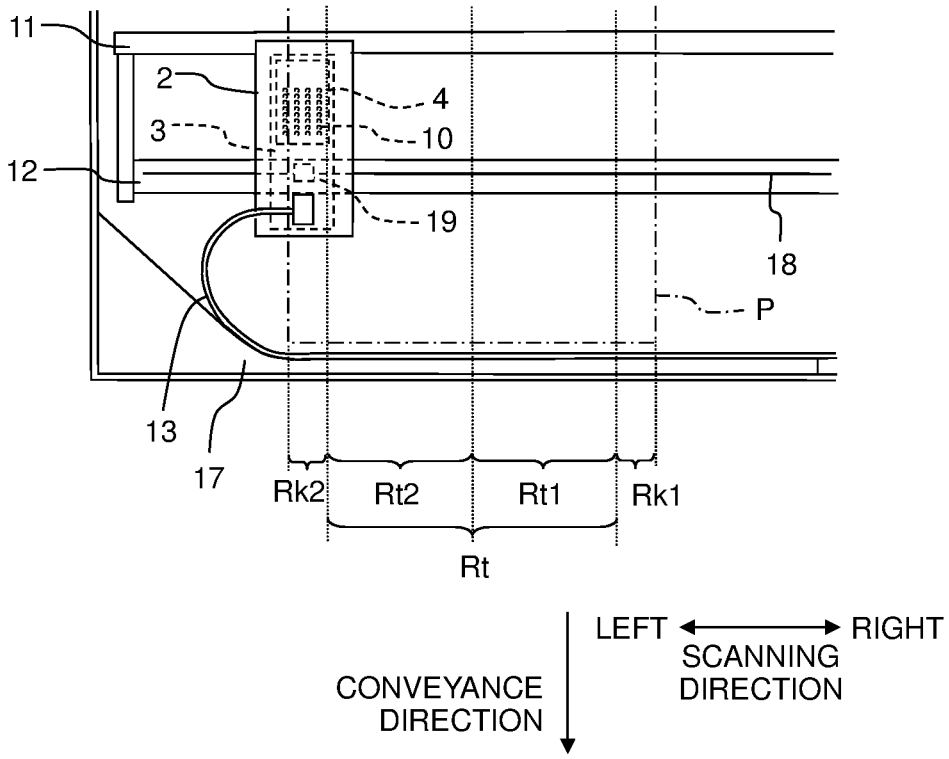
FIG. 10B illustrates the tube when the carriage is positioned in a left acceleration/deceleration area.

In this embodiment, when the carriage 2 is positioned in the area Rk2 as depicted in FIG. 10B, the length of the portion of each tube 13 brought into contact with the wall 17 is longer than a case where the carriage 2 is positioned in the area Rk1 as depicted in FIG. 10A. Thus, in the state where the carriage 2 is positioned in the area Rk2, the degree of curve of the tubes 13 is higher than the case where the carriage 2 is positioned in the area Rk1, and the force applied from the tubes 13 to the carriage 2 is large.

Thus, when the carriage 2 is positioned in the area Rk2, the force applied from the tubes 13 is more likely to change the moving velocity of the carriage 2 rapidly than the case where the carriage 2 is positioned in the right area Rk1. In the state where the moving velocity of the carriage 2 is likely to change rapidly, when the expression of the approximate line is calculated based on the distribution of the moving velocities of the carriage 2 indicated by few pieces of preceding velocity information, and when the moving velocity of the carriage 2 is inferred based on the expression of the approximate line, the inferred moving velocity of the carriage 2 may be affected by the rapid change in moving velocity of the carriage 2. As a result, when the discharge timing is determined based on the inferred moving velocity of the carriage 2, the ink landing position in the scanning direction may greatly shift from an ideal position.

In view of the above, in this embodiment, when the carriage 2 is positioned in the left area Rk2, the expression of the approximate line is calculated based on the distribution of the moving velocities of the carriage 2 indicated by more pieces of velocity information than the case where the carriage 2 is positioned in the right area Rk1, and the moving velocity of the carriage 2 is inferred based on the expression of the approximate line.

Accordingly, when the carriage 2 is positioned in the area Rk2 where the force from the tubes 13 is likely to change the moving velocity of the carriage 2 rapidly, the effect of the rapid change in the moving velocity of the carriage 2 on the expression of the approximate line is small. Namely, the inferred moving velocity of the carriage 2 is not likely to be affected by the rapid change in the moving velocity of the carriage 2 due to the force from the tubes 13. As a result, it is possible to appropriately determine the discharge timing based on the inferred moving velocity of the carriage 2.

When the carriage 2 is positioned in the area Rk1 where the force from the tubes 13 is not likely to change the moving velocity of the carriage 2 rapidly, the moving velocity of the carriage 2 is inferred based on few pieces of preceding velocity information. It is thus possible to determine the discharge timing appropriately based on the inferred moving velocity of the carriage 2.

In this embodiment, the information about the moving velocity of the carriage 2 can be obtained based on the detection result of the slit 18*a* of the encoder scale 18 by the encoder sensor 19.

In this embodiment, when the encoder sensor 19 is positioned in the same position as the dirty portion 18*b* in the scanning direction, the encoder sensor 19 cannot detect the slit 18*a*. Thus, in this case, when the moving velocity of the carriage 2 is inferred based on the signal output from the encoder sensor 19, and when the discharge timing is determined based on the inferred moving velocity of the carriage 2, the determined discharge timing may be greatly deviated from an ideal discharge timing.

Thus, in this embodiment, when the carriage 2 is positioned in the area Rt, and when the encoder sensor 19 is positioned in the same position as the dirty portion 18*b* in the scanning direction, the discharge timing is determined based on reference velocity information set in advance.

Further, when the carriage 2 is positioned in the area Rk1 or the area Rk2, and when the encoder sensor 19 is positioned in the same position as the dirty portion 18*b* in the scanning direction, the moving velocity of the carriage 2 is inferred based on the right reference straight line or the left reference straight line set in advance, and the discharge timing is determined based on the inferred moving velocity of the carriage 2.

Accordingly, when the encoder scale 18 includes the dirty portion 18*b*, the discharge timing is not greatly deviated from the ideal discharge timing.

In this embodiment, when the velocity information in the preceding N-areas Rt is saved in the flash memory 54, the average value of the moving velocities of the carriage 2 indicated by the velocity information in the preceding N-areas Rt is inferred as the moving velocity of the carriage 2. On the other hand, for example, immediately after the movement of the carriage 2 at the constant velocity starts, the velocity information in the preceding N-areas Rt is not saved in the flash memory 54. Thus, in this embodiment, when the velocity information in the preceding N-areas Rt is not saved in the flash memory 54, an average value of the moving velocities of the carriage 2 indicated by pieces of preceding velocity information, the number of which is fewer than N, is inferred as the moving velocity of the carriage 2.

In this embodiment, when the velocity information in the preceding N-areas Rk1 or the preceding N-areas Rk2 is saved in the flash memory 54, the expression of the approximate line L3 is calculated using the least squares method based on the distribution of the velocity information in the preceding N-areas Rk1 or the preceding N-areas Rk2. The moving velocity of the carriage 2 is inferred based on the expression of the approximate line L3. On the other hand, for example, immediately after the acceleration or deceleration of the carriage 2 starts, the velocity information in the preceding N-areas Rk1 or the preceding N-areas Rk2 is not saved in the flash memory 54. Thus, in this embodiment, when the velocity information in the preceding N-areas Rk1 or the preceding N-areas Rk2 is not saved in the flash memory 54, the expression of the approximate line L4 is calculated based on the distribution of the moving velocities of the carriage 2 indicated by pieces of preceding velocity information in the areas Rk1, Rk2, the number of which is fewer than N. The moving velocity of the carriage 2 is inferred based on the expression of the approximate line L4.

In this embodiment, the multiplication signal obtained by multiplying the frequency of the signal output from the encoder sensor 19 is corrected based on the inferred moving velocity of the carriage 2, and the plurality of continuous discharge timings are determined based on the corrected multiplication signal. This allows ink to land on the recording sheet P at intervals in the scanning direction shorter than the interval W between the slits 18*a* of the encoder scale 18, and thus recording can be performed in the scanning direction with high resolution.

Modified Embodiments

The embodiment of the present disclosure is explained above. The present disclosure, however, is not limited to the above embodiment. Various changes or modifications may be made without departing from the claims.

For example, in the above embodiment, the multiplication signal obtained by multiplying the frequency of the signal output from the encoder sensor 19 is corrected based on the inferred moving velocity of the carriage 2, and the plurality of continuous discharge timings are determined based on the corrected multiplication signal. The aspects of the present disclosure, however, are not limited thereto. For example, when ink lands on the recording sheet P at intervals in the scanning direction identical to the interval W between the slits 18*a* of the encoder scale 18, the signal output from the encoder sensor 19 is corrected based on the inferred moving velocity of the carriage 2, and one discharge timing may be determined based on the corrected signal.

In the above embodiment, when the carriage 2 is positioned in the area Rk1 or the area Rk2, the information about the moving velocities of the carriage 2 in the preceding N-areas Rk1 or the preceding N-areas Rk2 may not be saved in the flash memory 54. In such a case, the expression of the approximate line indicating the change in moving velocity of the carriage 2 is calculated based on the information about the moving velocities of the carriage 2 in all the preceding areas Rk1, the number of which is less than N, or all the preceding areas Rk2, the number of which is less than N. The moving velocity of the carriage 2 is inferred based on the expression of the approximate line. The aspects of the present disclosure, however, are not limited thereto.

For example, when the carriage 2 is positioned in the area Rk1 or the area Rk2, and when the information about the moving velocities of the carriage 2 in the preceding N-areas Rk1 or the preceding N-areas Rk2 is not saved in the flash memory 54, the moving velocity of the carriage 2 may be inferred based on the expression of the right reference straight line or the expression of the left reference straight line.

In the above embodiment, when the carriage 2 is positioned in the area Rt, the information about the moving velocities of the carriage 2 in the preceding N-areas Rt may not be saved in the flash memory 54. In such a case, the average value of the movement velocities of the carriage 2 indicated by the information about the moving velocities of the carriage 2 in all the preceding areas Rt, the number of which is less than N, is inferred as the moving velocity of the carriage 2. The aspects of the present disclosure, however, are not limited thereto.

For example, when the carriage 2 is positioned in the area Rt, and when the information about the moving velocities of the carriage 2 in the preceding N-areas Rt is not saved in the flash memory 54, the reference velocity may be inferred as the moving velocity of the carriage 2.

In the above embodiment, when the carriage 2 is positioned in the area Rk1 or the area Rk2, the encoder sensor 19 may be positioned in the same position as the dirty portion 18*b* of the encoder scale 18 in the scanning direction. In such a case, the moving velocity of the carriage 2 is inferred based on the expression of the right reference straight line and the expression of the left reference straight line. The aspects of the present disclosure, however, are not limited thereto. For example, the expression of the approximate line indicating the change in moving velocity of the carriage 2 may be calculated based on the information about the moving velocities of the carriage 2 in the plurality of preceding areas Rk1, Rk2 at a timing earlier than a timing at which the encoder sensor 19 is positioned in the same position as the dirty portion 18*b* in the scanning direction. The moving velocity of the carriage 2 may be inferred based on the expression of the approximate line.

In the above embodiment, when the carriage 2 is positioned in the area Rt, the encoder sensor 19 may be positioned in the same position as the dirty portion 18*b* of the encoder scale 18 in the scanning direction. In such a case, the reference velocity is inferred as the moving velocity of the carriage 2. The aspects of the present disclosure, however, are not limited thereto. For example, the average value of the information about the moving velocities of the carriage 2 in the preceding N-areas Rt may be inferred as the moving velocity of the carriage 2.

In the above embodiment, the information about the moving velocity of the carriage 2 is obtained by the optical linear encoder 8 in which the encoder sensor 19 detects each slit 18*a* of the encoder scale 18. The aspects of the present disclosure, however, are not limited thereto. For example, the information about the moving velocity of the carriage 2 may be obtained using a magnetic liner encoder. Or, for example, a sensor that outputs a signal depending on a moving velocity itself (the velocity signal output circuit of the present disclosure) may be provided in the carriage 2.

In the above embodiment, the tubes 13 curve when seen from above. Further, the printer 1 is provided with the wall 17 that is brought into contact with the curved tubes 13 from the downstream side in the conveyance direction (the outside of the curve). The aspects of the present disclosure, however, are not limited thereto. For example, the tubes may curve when seen from the conveyance direction. In that case, the printer may be provided with a wall that is brought into contact with the tubes from the upper side or lower side corresponding to the outside of the curve of the tubes. Further, the printer may not include the wall brought into contact with the tubes.

In the above embodiment, when the carriage 2 is positioned in the area Rk1 or the area Rk2, the expression of the approximate line is calculated based on preceding continuous N-pieces of information about the moving velocities of the carriage 2. When the carriage 2 is positioned in the area Rk1, the predefined number N is set to Nk1. When the carriage 2 is positioned in the area Rk2, the predefined number N is set to Nk2 larger than Nk1. The aspects of the present disclosure, however, are not limited thereto.

For example, the area Rk1 may be divided into two or more areas arranged in the conveyance direction. The predefined number N may be larger as the carriage 2 is positioned in an area closer to the left side included in the two or more areas. Similarly, for example, the area Rk2 may be divided into two or more areas arranged in the conveyance direction. The predefined number N may be larger as the carriage 2 is positioned in an area closer to the left side included in the two or more areas. In these cases, a position in the scanning direction in the area closer to the left side included in any two areas of the above two or more areas corresponds to a "first acceleration/deceleration position" of the present disclosure. A position in the scanning direction in the area closer to the right side corresponds to a "second acceleration/deceleration position" of the present disclosure.

Or, for example, the tubes 13 may be made from a material having a relatively small rigidity, and the force applied from the tubes 13 to the carriage 2 may have small effect on the moving velocity of the carriage 2. In such a case, the expression of the approximate line may be calculated based on the same number of pieces of preceding information about the moving velocities of the carriage 2 irrespectively of the position in the scanning direction of the carriage 2 within the area Rk1 or the area Rk2.

In the above embodiment, when the carriage 2 is positioned in the area Rt, the average value of the moving velocities of the carriage 2 indicated by preceding continuous N-pieces of information about the moving velocities of the carriage 2 is inferred as the moving velocity of the carriage 2. Further, when the carriage 2 is in the right area Rt1, the predefined number N is set to Nk1. When the carriage 2 is in the left area Rt2, the predefined number N is set to Nk2 larger than Nk1. The aspects of the present disclosure, however, are not limited thereto.

For example, the area Rt may be divided into two or more areas arranged in the conveyance direction that are different from the right area Rt1 and the left area Rt2 in the above embodiment. The predefined number N may be larger as the carriage 2 is positioned in an area closer to the left side included in the two or more areas. In this case, a position in the scanning direction in the area closer to the left side included in any two areas of the above two or more areas corresponds to a "first constant velocity position" of the present disclosure. A position in the scanning direction in an area closer to the right side corresponds to a "second constant velocity position" of the present disclosure.

Or, for example, the tubes 13 may be made from a material having a relatively small rigidity, and the force applied from the tubes 13 to the carriage 2 may have small effect on the moving velocity of the carriage 2. In such a case, the average value of the moving velocities of the carriage 2 indicated by the same number of pieces of preceding information about the moving velocities of the carriage 2 may be inferred as the moving velocity of the carriage 2 irrespective of the position in the scanning direction of the carriage 2 within the area Rt.

In the above embodiment, the ink cartridges 15 that are removably installed in the cartridge holder 14 are connected to the ink-jet head 4 via the tubes 13 or the like. The aspects of the present disclosure, however, are not limited thereto. For example, ink tanks (the liquid supply source of the present disclosure) provided with ink supply ports may be fixed to the casing 1*a* of the printer 1. The ink tanks may be connected to the ink-jet head 4 via the tubes or the like. In this case, inks in bottles can be supplied from the supply ports to the ink tanks.

In the above embodiment, when the carriage 2 is positioned in the area Rt, the average value of the moving velocities of the carriage 2 indicated by the plurality of pieces of preceding velocity information is inferred as the moving velocity of the carriage 2. The aspects of the present disclosure, however, are not limited thereto. For example, when the carriage 2 is positioned in the area Rt, a representative value except for the average value, such as a median or mode of the moving velocities of the carriage 2 indicated by the plurality of pieces of preceding velocity information, may be inferred as the moving velocity of the carriage 2.

In the above embodiment, when the carriage 2 is positioned in area Rk1 or the area Rk2, the controller calculates the expression of the approximate line that is approximated by the least squares method based on the distribution of the moving velocities of the carriage 2 indicated by the plurality of pieces of preceding velocity information. The aspects of the present disclosure, however, are not limited thereto. For example, the controller may calculate an expression of an approximate line that is approximated by any other approximation method than the least squares method based on the distribution of the moving velocities of the carriage 2 indicated by the plurality of pieces of preceding velocity information. Or, for example, when the acceleration rate of the carriage 2 in the area Rk1 or the area Rk2 is not constant, an expression of an approximate curve, such as a quadratic curve or cubic curve, indicating the change in moving velocity of the carriage 2 may be calculated based on the distribution of the moving velocities of the carriage 2 indicated by the plurality of pieces of preceding velocity information.

The examples in which the present disclosure is applied to the printer including a so-called serial head in which ink is discharged from the nozzles 10 of the ink-jet head 4 carried on the carriage 2 during movement in the scanning direction of the carriage 2, are described above. The aspects of the present disclosure, however, are not limited thereto.

Figure 11:
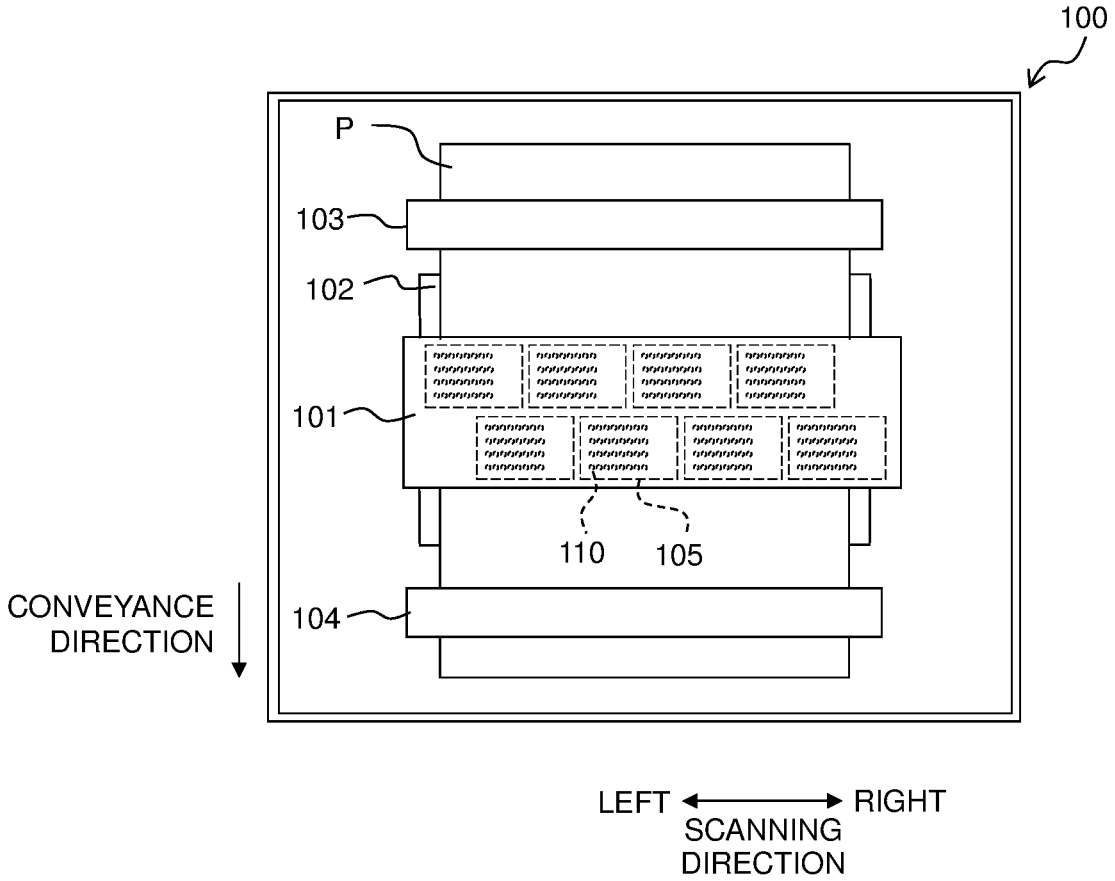
FIG. 11 schematically depicts a printer 100.

For example, in a modified embodiment, as depicted in FIG. 11, a printer 100 includes a head unit 101 (the liquid discharge head of the present disclosure), a platen 102, conveyance rollers 103 and 104 (the relative movement mechanism of the present disclosure).

The head unit 101 includes eight ink-jet heads 105 and a holding member 106. For example, the ink-jet heads 105 are similar to the ink-jet head 4 of the above embodiment. The ink-jet heads 105 are arranged so that an arrangement direction of the nozzles 10 are parallel to the scanning direction. Four of the eight ink-jet heads 105 are arranged in the scanning direction to form two rows of ink-jet heads 105. The two rows of ink-jet heads 105 are arranged in the conveyance direction. The positions of the ink-jet heads 105 belonging to one of the two rows are shifted in the scanning direction from those belonging to the other. Thus, in the head unit 101, nozzles 110 of the eight ink-jet heads 105 are arranged to extend over an entire length of the recording sheet P in the scanning direction. Namely, the head unit 101 is a so-called line head. The holding member 106 is a rectangular plate-like member of which longitudinal direction is the scanning direction. The holding member 106 holds the eight ink-jet heads 105 in the above positional relationship.

The platen 102 is similar to the platen 5 of the above embodiment. The conveyance rollers 103 and 104 are similar to the conveyance rollers 6 and 7 in the above embodiment. The conveyance rollers 103 and 104 are connected to a conveyance motor 127 (see FIG. 12) via a gear or the like (not depicted).

Figure 12:
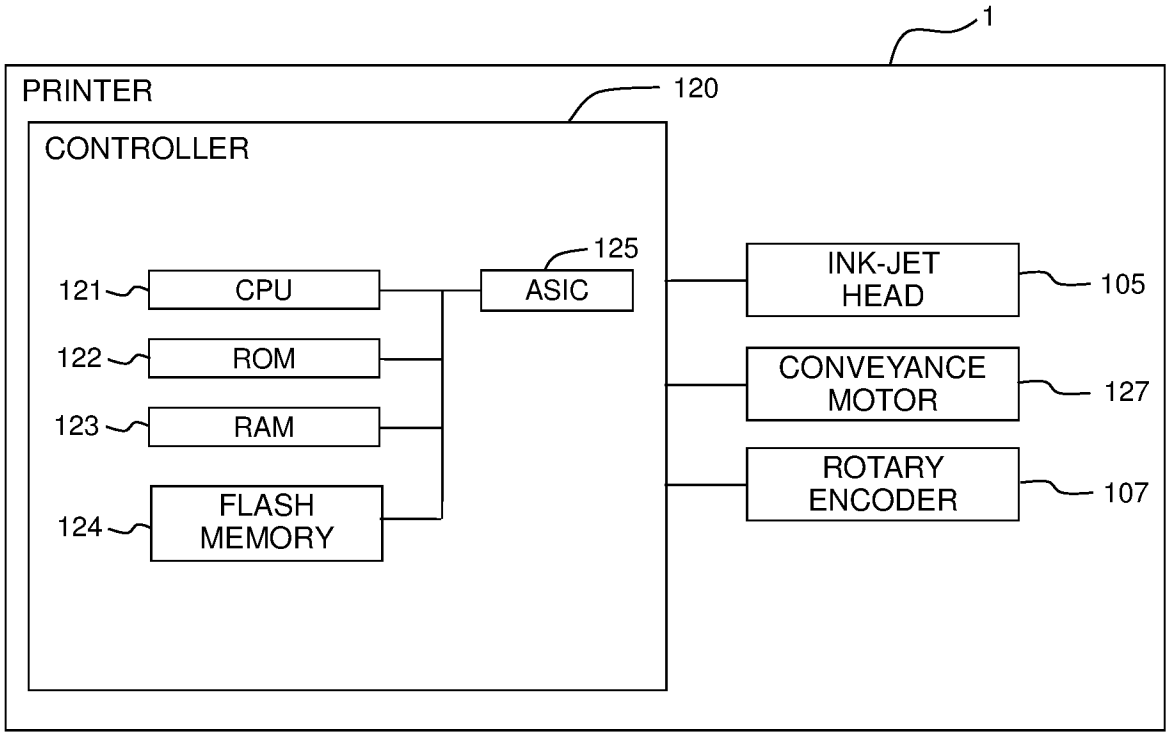
FIG. 12 is a block diagram depicting an electrical configuration of the printer 100.

The operations of the printer 100 are controlled by a controller 120. As depicted in FIG. 12, the controller 120 includes a CPU121, a ROM122, a RAM123, a flash memory 124, an ASIC 125 and the like. The controller 120 controls the operations of the ink-jet heads 105, the conveyance motor 127, and the like. In addition to the above configuration, the printer 100 includes a rotary encoder 107 (the velocity signal output circuit of the present disclosure). The rotary encoder 107 is provided for any of the conveyance rollers 103 and 104. The rotary encoder 107 outputs a signal depending on a rotation amount of the conveyance roller 103, 104 to the controller 120. The controller 120 obtains, based on the signal from the rotary encoder 107, a position in the conveyance direction of the recording sheet P and velocity information about a conveyance velocity of the recording sheet P (relative velocity between the head unit 101 and the recording sheet P). Namely, in this modified embodiment, the rotary encoder 107 outputs a velocity signal about the conveyance velocity of the recording sheet P.

In the printer 100, the controller 120 controls the ink-jet heads 105 to discharge ink(s) from the nozzles 110 while controlling the conveyance motor 127 to convey the recording sheet P in the conveyance direction by use of the conveyance rollers 103 and 104. Accordingly, recording is performed on the recording sheet P. In this modified embodiment, when the recording sheet P is conveyed in the conveyance direction by use of the conveyance rollers 103 and 104, the relative movement between the head unit 101 and the recording sheet P in the conveyance direction (one direction of the present disclosure) is performed.

Here, as depicted in FIG. 12, when the conveyance of the recording sheet P by use of the conveyance rollers 103 and 104 starts, the conveyance velocity of the recording sheet P increases and then becomes constant. Then, the controller 120 controls the ink-jet heads 105 to discharge ink(s) from the nozzles 110 to the recording sheet P both in an acceleration period Tk in which the conveyance velocity increases and in a constant velocity period Tt in which the conveyance velocity is constant.

In this modified embodiment, the operation included in the operations for performing recording on the recording sheet P and in which ink is discharged from the nozzles 110 to the recording sheet P during the conveyance in the conveyance direction of the recording sheet P with the conveyance velocity being increased, corresponds to an acceleration/deceleration discharge operation of the present disclosure. The operation included in the operations for performing recording on the recording sheet P and in which ink is discharged from the nozzles 10 to the recording sheet P during the conveyance in the conveyance direction of the recoding sheet P at a constant conveyance velocity, corresponds to the constant velocity discharge operation of the present disclosure.

Figure 13:
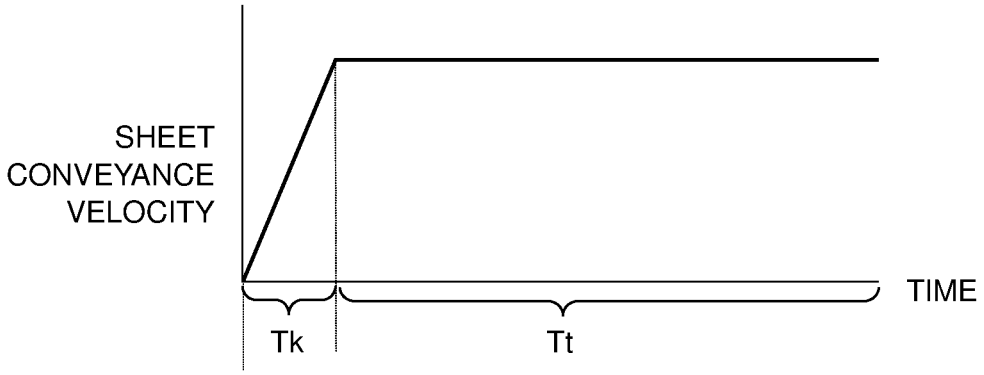
FIG. 13 illustrates a change in conveyance velocity at the time of recording in the printer 100.

When the printer 100 performs recording on the recording sheet P, ink is required to be discharged from the nozzles 110 at an appropriate discharge timing in order to allow ink to land on appropriate positions on the recoding sheet P, for example, to allow ink to land on the recording sheet P at regular intervals in the conveyance direction. The landing positions of ink in the conveyance direction on the recording sheet P when ink is discharged from the nozzles 10 at a certain discharge timing vary depending on the conveyance velocity of the recording sheet P. Thus, in the printer 100, the discharge timing is determined by causing the controller 120 to perform the processes in accordance with the flowchart of FIG. 13 during recording on the recording sheet P. In the recording on the recording sheet P, ink is discharged from the nozzles 110 at the determined discharge timing.

Figure 14A:
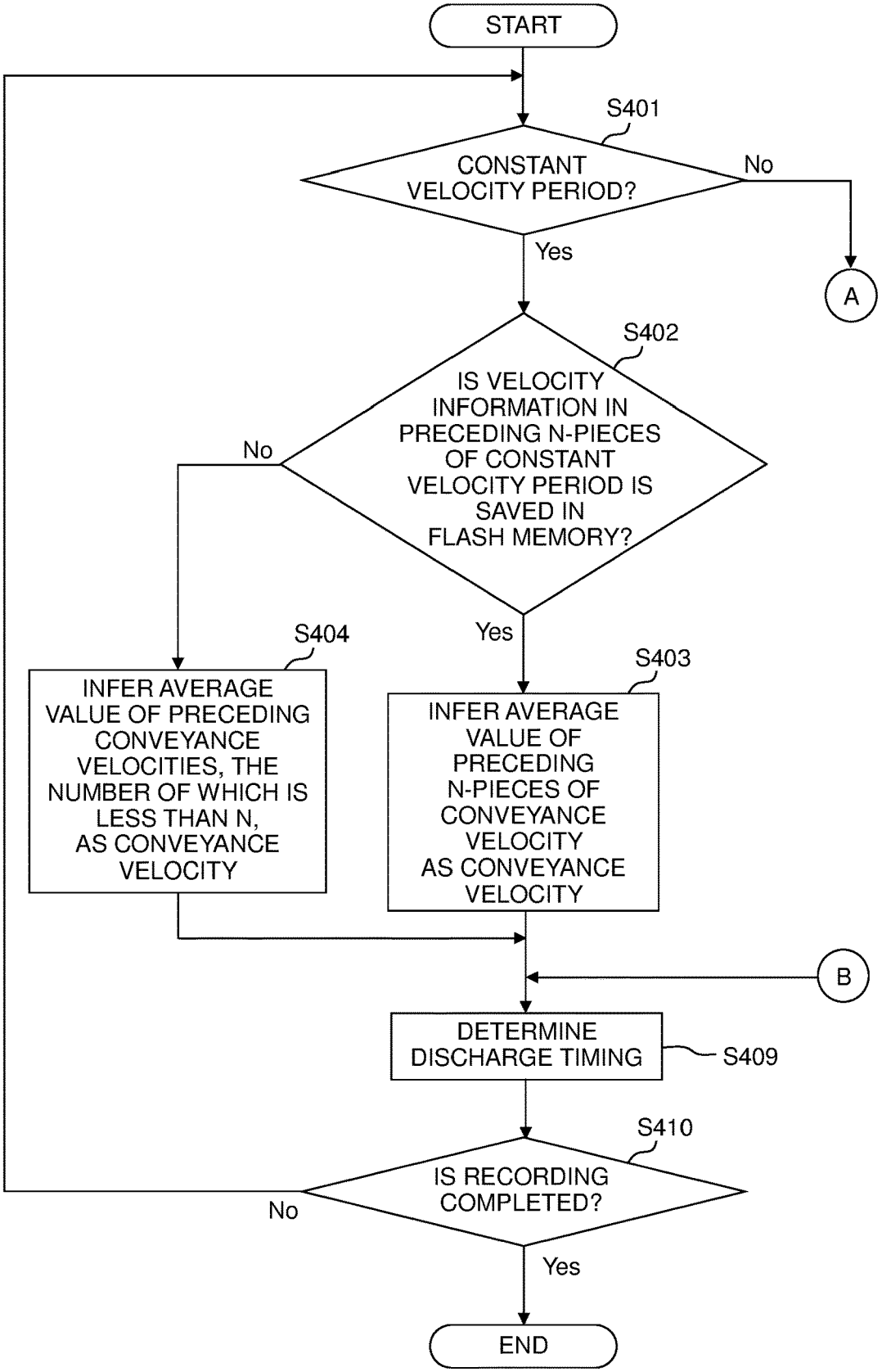
FIGS. 14A and 14B depicts a flowchart indicating processes for determining a discharge timing at the time of recording in the printer 100.
Figure 14B:
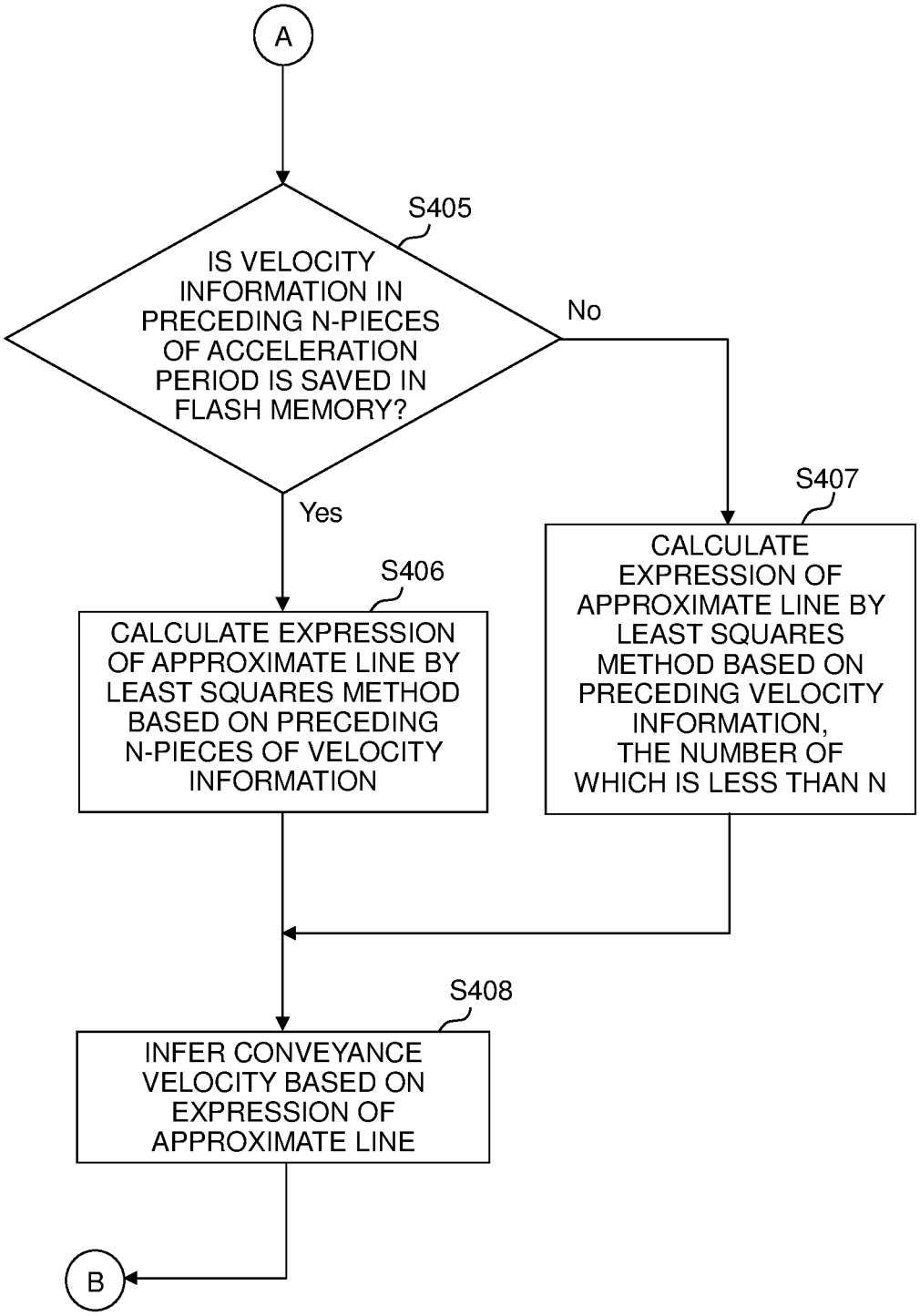

More specifically, as depicted in FIGS. 14A and 14B, in the constant velocity period Tt (S401: YES), the controller 120 determines whether information about conveyance velocities in preceding N-pieces of constant velocity period Tt (hereinafter simply referred to as preceding N-constant velocity periods Tt) is saved in the flash memory 124 (S402). For example, after a certain period of time elapses since the start of the conveyance of the recording sheet P at the constant conveyance velocity, the information about the conveyance velocities in the preceding N-constant velocity periods Tt is saved in the flash memory 124. On the other hand, for example, immediately after the conveyance of the recording sheet P at the constant conveyance velocity starts, the information about the conveyance velocities in the preceding N-constant velocity periods Tt is not saved in the flash memory 124. In this modified embodiment, the predefined number N is set in advance. The predefined number N is saved in the flash memory 124.

When the information about the conveyance velocities in the preceding N-constant velocity periods Tt is saved in the flash memory 124 (S402: YES), the controller 120 infers an average value of the conveyance velocities indicated by the velocity information in the preceding N-constant velocity periods Tt, as the conveyance velocity of the recording sheet P (S403). When the information about the conveyance velocities in the preceding N-constant velocity periods Tt is not saved in the flash memory 124 (S402: NO), the controller 120 infers the average value of the conveyance velocities indicated by the information about the conveyance velocities in all the preceding constant velocity periods Tt, the number of which is less than N, as the conveyance velocity of the recording sheet P (S404).

In the acceleration period Tk (S401: NO), the controller 120 determines whether information about conveyance velocities in preceding N-pieces of acceleration period Tk (hereinafter simply referred to as preceding N-acceleration periods Tk) is saved in the flash memory 124 (S405). For example, after a certain period of time elapses since the increase in the conveyance velocity of the recording sheet P, the information about the conveyance velocities in the preceding N-acceleration periods Tk is saved in the flash memory 124. On the other hand, for example, immediately after the conveyance velocity of the recording sheet P increases, the information about the conveyance velocities in the preceding N-acceleration periods Tk is not saved in the flash memory 124.

When the information about the conveyance velocities in the preceding N-acceleration periods Tk is saved in the flash memory 124 (S405: YES), the controller 120 calculates an expression of an approximate line indicating a change in conveyance velocity that is approximated by the least squares method based on the distribution of the conveyance velocities indicated by the information about the conveyance velocities in the preceding N-acceleration periods Tk (S406). When the information about the conveyance velocities in the preceding N-acceleration periods Tk is not saved in the flash memory 124 (S405: NO), the controller 120 calculates an expression of an approximate line indicating a change in conveyance velocity that is approximated by the least squares method based on the distribution of the conveyance velocities indicated by the information about the conveyance velocities in all the preceding acceleration periods Tk, the number of which is less than N (S407). The conveyance velocity of the recoding sheet P is inferred based on the expression of the approximate line calculated in S406 or S407 (S408).

After inferring the conveyance velocity of the recording sheet P in any of S403, S404, and S408, the controller 120 determines a discharge timing based on the inferred conveyance velocity (S409).

In this modified embodiment, the processes of S401 to S409 are repeated until the recording on the recording sheet P is completed (S410: NO). When recording on the recording sheet P is completed (S410: YES), the series of processes is completed.

In this modified embodiment, in the constant velocity period Tt in which the recording sheet P is conveyed at the constant conveyance velocity, the average value of the conveyance velocities of the recording sheet P indicated by the plurality of pieces of preceding velocity information is inferred as the conveyance velocity of the recording sheet P. Thus, it is possible to accurately infer the conveyance velocity of the recording sheet P when the recording sheet P is conveyed at the constant conveyance velocity and to appropriately determine the discharge timing based on the inferred conveyance velocity of the recording sheet P.

On the other hand, in the acceleration period Tk in which the conveyance velocity of the recording sheet P increases, the controller 120 calculates the expression of the approximate line indicating the change in conveyance velocity of the recording sheet P that is approximated by the least squares method based on the distribution of the conveyance velocities of the recording sheet P indicated by the plurality of pieces of preceding velocity information. The conveyance velocity of the recording sheet P is inferred based on the expression of the approximate line. Thus, it is possible to accurately infer the conveyance velocity of the recording sheet P while the conveyance velocity of the recording sheet P increases and to appropriately determine the discharge timing based on the inferred conveyance velocity of the recording sheet P.

The examples in which the present disclosure is applied to the printer that discharges ink from nozzles to perform recording on a recording sheet P are explained above. The aspects of the present disclosure, however, are not limited thereto. The present disclosure is applicable to an image recording apparatus that performs image recording on any other recording medium than the recording sheet, such as a T-shirt, a sheet for out-of-home advertising, a case of a mobile terminal including a smartphone, cardboard, and a resin member. Further, the present disclosure is applicable to a liquid discharge apparatus discharging any other liquid than ink, such as liquefied resin and liquefied metal.

What is claimed is:

1. A liquid discharge apparatus configured to discharge a liquid on a medium, comprising:

a liquid discharge head including a nozzle and a nozzle surface in which the nozzle is opened;

a relative movement mechanism configured to perform relative movement between the liquid discharge head and the medium in a direction parallel to the nozzle surface;

a velocity signal output circuit configured to output a velocity signal related to a relative velocity between the liquid discharge head and the medium; and a controller, wherein, in a case that the liquid is discharged from the nozzle toward the medium, the controller is configured to:

obtain velocity information about the relative velocity based on the velocity signal output from the velocity signal output circuit;

perform a constant velocity discharge operation in which the liquid discharge head discharges the liquid from the nozzle while relative movement between the liquid discharge head and the medium at a constant relative velocity is performed; and perform an acceleration/deceleration discharge operation in which the liquid discharge head discharges the liquid while the relative movement between the liquid discharge head and the medium is performed such that the relative velocity increases or decreases, the velocity information includes a plurality of pieces of preceding velocity information, in the constant velocity discharge operation, the controller is configured to:

obtain information about a representative value of the relative velocity based on the pieces of preceding velocity information; and determine a discharge timing of the liquid from the nozzle based on the information about the representative value, in the acceleration/deceleration discharge operation, the controller is configured to:

calculate a coefficient of a variable in an approximate expression, the variable of the approximate expression being a relative position of the liquid discharge head relative to the medium in the direction parallel to the nozzle surface, and, in the approximate expression, a change in the relative velocity being approximated based on distribution of the relative velocity indicated by the pieces of preceding velocity information; and determine a discharge timing of the liquid from the nozzle based on the approximate expression.

2. The liquid discharge apparatus according to claim 1, wherein, in the acceleration/deceleration discharge operation, the controller is configured to calculate the approximate expression that is approximated by a least squares method based on the distribution of the relative velocity indicated by the pieces of preceding velocity information.

3. The liquid discharge apparatus according to claim 1, wherein, in the constant velocity discharge operation, the controller is configured to obtain information about an average value of the relative velocity indicated by the pieces of preceding velocity information, as the information about the representative value of the relative velocity.

4. The liquid discharge apparatus according to claim 1, wherein the relative movement mechanism includes a carriage carrying the liquid discharge head and is configured to move in a scanning direction as one direction, the velocity signal output circuit outputs a signal about a moving velocity of the carriage, as the velocity signal, the controller is configured to:

obtain, as the velocity information, information about the moving velocity of the carriage based on the velocity signal output from the velocity signal output circuit;

control the liquid discharge head to perform the constant velocity discharge operation in which the liquid is discharged from the nozzle while moving the carriage at a constant moving velocity, in a case that the carriage is positioned in a predefined constant velocity area in the scanning direction; and control the liquid discharge head to perform the acceleration/deceleration discharge operation in which the liquid is discharged from the nozzle while accelerating or decelerating the carriage, in a case that the carriage is positioned in an acceleration/deceleration area, which is adjacent to the constant velocity area at either side of the constant velocity area in the scanning direction, in the constant velocity discharge operation, the controller is configured to:

obtain information about a representative value of the moving velocity of the carriage based on the pieces of preceding velocity information; and determine a discharge timing of the liquid from the nozzle based on the information about the representative value, in the acceleration/deceleration discharge operation, the controller is configured to:

calculate an approximate expression in which a change in the moving velocity of the carriage is approximated based on distribution of the relative velocity indicated by the pieces of preceding velocity information; and determine a discharge timing of the liquid from the nozzle based on the approximate expression.

5. The liquid discharge apparatus according to claim 4, further comprising:

a tube having a first end and a second end and curving between the first end and the second end, the first end being connected to the liquid discharge head, the second end being connected to a liquid supply source that contains the liquid to be supplied to the liquid discharge head; and a wall disposed outside the curve of the tube, wherein a first length of a portion of the tube is brought into contact with the wall in a state where the carriage is positioned in a first constant velocity position in the constant velocity area in the scanning direction, a second length of the portion of the tube is brought into contact with the wall in a state where the carriage is positioned in a second constant velocity position in the constant velocity area in the scanning direction, the second constant velocity position being different from the first constant velocity position, the first length being longer than the second length of the portion of the tube, in the constant velocity discharge operation, in the case that the carriage is positioned in the first constant velocity position, the controller is configured to obtain the information about the representative value of the moving velocities of the carriage based on the pieces of preceding velocity information, the number of which is larger than that in the case that the carriage is positioned in the second constant velocity position.

6. The liquid discharge apparatus according to claim 4, further comprising:

a tube having a first end and a second end and curving between the first end and the second end, the first end being connected to the liquid discharge head, the second end being connected to a liquid supply source that contains the liquid to be supplied to the liquid discharge head; and a wall disposed outside the curve of the tube, wherein a first length of a portion of the tube is brought into contact with the wall in a state where the carriage is positioned in a first acceleration/deceleration position in the acceleration/deceleration area in the scanning direction, a second length of the portion of the tube is brought into contact with the wall in a state where the carriage is positioned in a second acceleration/deceleration position in the acceleration/deceleration area in the scanning direction, the second acceleration/deceleration position being different from the first acceleration/deceleration position, the first length of a portion of the tube is longer than a second length of a portion of the tube, in the constant velocity discharge operation, in the case that the carriage is positioned in the first acceleration/deceleration position, the controller is configured to obtain the approximate expression based on the pieces of preceding velocity information, the number of which is larger than that in the case that the carriage is positioned in the second acceleration/deceleration position.

7. The liquid discharge apparatus according to claim 4, wherein the velocity signal output circuit includes: an encoder scale that extends in the scanning direction and includes a plurality of detection targets arranged in the scanning direction; and an encoder sensor that is carried on the carriage, is configured to detect each of the detection targets, and is configured to output a signal depending on a detection result of each of the detection targets.

8. The liquid discharge apparatus according to claim 7, further comprising a memory, wherein information about a position in the scanning direction of a dirty portion of the encoder scale to which a foreign substance is adhered is saved in the memory, and reference velocity information, which is information about the moving velocity of the carriage in the constant velocity area set in advance, is saved in the memory, in a case that the position in the scanning direction of the dirty portion of the encoder scale saved in the memory is positioned in the constant velocity area, and in a case that the encoder sensor is positioned in the same position as the dirty portion in the scanning direction in the constant velocity discharge operation, the controller is configured to determine the discharge timing based on the reference velocity information.

9. The liquid discharge apparatus according to claim 7, further comprising a memory, wherein information about a position in the scanning direction of a dirty portion of the encoder scale to which a foreign substance is adhered is saved in the memory, and reference velocity change information, which is information about a change in the moving velocity of the carriage set in advance, is saved in the memory, in a case that the position in the scanning direction of the dirty portion of the encoder scale saved in the memory is positioned in the acceleration/deceleration area, and in a case that the encoder sensor is positioned in the same position as the dirty portion in the scanning direction in the acceleration/deceleration discharge operation, the controller is configured to determine the discharge timing based on the reference velocity change information.

10. The liquid discharge apparatus according to claim 7, wherein the controller is configured to generate a multiplication signal obtained by multiplying a frequency of the signal output from the encoder sensor, the discharge timing includes a plurality of continuous discharge timings, in the constant velocity discharge operation, the controller is configured to:

correct the multiplication signal based on the information about the representative value; and determine the plurality of continuous discharge timings based on the multiplication signal corrected, in the acceleration/deceleration discharge operation, the controller is configured to:

correct the multiplication signal based on the approximate expression; and determine the plurality of continuous discharge timings based on the multiplication signal corrected.

11. The liquid discharge apparatus according to claim 1, wherein the velocity information includes predefined number of pieces of preceding velocity information, in the constant velocity discharge operation, the controller is configured to obtain the information about the representative value based on the predefined number of pieces of preceding velocity information, and in a case that the predefined number of pieces of preceding velocity information is not obtained, the information about the representative value is obtained based on the velocity information, the number of which is fewer than the predefined number of pieces of preceding velocity information.

12. The liquid discharge apparatus according to claim 1, wherein the velocity information includes a predefined number of pieces of preceding velocity information, in the acceleration/deceleration discharge operation, the controller is configured to calculate the approximate expression based on the predefined number of pieces of preceding velocity information, and in a case that the predefined number of pieces of preceding velocity information is not obtained, the approximate expression is obtained based on the velocity information, the number of which is fewer than the predefined number of pieces of preceding velocity information.

* * * * *